US007860445B2

(12) United States Patent
Suzuki

(10) Patent No.: US 7,860,445 B2
(45) Date of Patent: Dec. 28, 2010

(54) DOCUMENT FEEDER

(75) Inventor: Nobuhiko Suzuki, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 495 days.

(21) Appl. No.: 11/594,093

(22) Filed: Nov. 8, 2006

(65) Prior Publication Data

US 2007/0104524 A1 May 10, 2007

(30) Foreign Application Priority Data

Nov. 8, 2005 (JP) ..... 2005-323129

(51) Int. Cl.
*G03G 15/00* (2006.01)

(52) U.S. Cl. ..... 399/367; 399/371; 399/373

(58) Field of Classification Search ..... 399/388, 399/364, 367; 271/291
See application file for complete search history.

(56) References Cited

U.S. PATENT DOCUMENTS 4,500,086 A * 2/1985 Garavuso ..... 271/225
5,384,631 A * 1/1995 Matsunami ..... 399/370
6,161,831 A 12/2000 Kusakabe et al.
6,209,861 B1 * 4/2001 Kakuta et al. ..... 271/3.02
2004/0207708 A1 * 10/2004 Ohashi et al. ..... 347/104

FOREIGN PATENT DOCUMENTS

JP 8-85649 A 4/1996
JP 11-263539 A 9/1999
JP 2004315166 A * 11/2004

* cited by examiner

*Primary Examiner*—Ren Yan
*Assistant Examiner*—Allister Primo
(74) *Attorney, Agent, or Firm*—McDermott Will & Emery LLP

(57) ABSTRACT

A document feeder includes a bidirectional feed path having both ends connected to predetermined positions of the bidirectional feed path, respectively. A document is fed from a downstream side of the image reading position to an upstream side with leading end and trailing end being reversed. The driving force is not transmitted when the rotation of the rotating member of the driving source is switched from one direction to the other, while the driving force is transmitted when an actuator is operated based on the driving system being rotated in the other direction. The actuator is actuated when the driving system is rotated in the other direction and the document is drawn in the bidirectional feed path. If the rotated amount of the driving source during the actuation of the actuator is less than a predetermined value, the actuator is actuated by a predetermined period.

12 Claims, 18 Drawing Sheets

DOCUMENT FEEDER

CROSS-REFERENCE TO RELATED APPLICATION

This application claims priority from Japanese Patent Application No. 2005-323129, filed on Nov. 8, 2005, the entire subject matter of which is incorporated herein by reference.

TECHNICAL FIELD

Illustrative aspects of the present invention relate to a document feeder suited for the double-sided reading of documents.

BACKGROUND

In the prior art, in image forming apparatuses such as a copier, a scanner, and a multi-function peripheral including functions of the copier and scanner, etc., an ADF (Auto Document Feeder) for feeding documents from a feeding tray to an output tray via a feed path has been known. Among such ADF's, one configured to execute a switchback feed of the document so that, for example, text printed on both sides of each sheet of the document has been known. In the bidirectional feeder, the leading end and the trailing end of a sheet are switched and both sides of the sheet are scanned consecutively. An example of such a document feeder is disclosed in Japanese Patent Provisional Publication No. HEI 8-85649 (hereinafter, referred to as '649 publication).

FIG. 17 shows a feeding path of a document feeder suited for the double-sided reading of documents. As shown in FIG. 17, document P is placed in an input tray 100 with the first sheet being the topmost sheet of the document P. The uppermost sheet is fed toward a feeding path 102 as a pickup roller 101 rotates. In the feeding path 102, the document P is fed by feed rollers 103 provided at various positions of the feeding path 200. When each sheet passes through a reading position X (indicated by arrow), a first surface of the sheet P is read using an image reading device such as a CCD or CIS. When a sensor detects the trailing end of the sheet P of which the first surface has been read, discharge rollers 104 are stopped with nipping a trailing end portion of the sheet P so that the sheet P is also stopped.

Thereafter, as the discharge rollers 104 reversely rotate, as shown in FIG. 18, the sheet P is fed into a bidirectional feed path 105. Then, the sheet P re-enters, from the bidirectional feed path 105, the feeding path 102 at an upstream side portion of the reading position X. With this movement, the leading end and the trailing end of the sheet P are exchanged. As the sheet P is fed by the feed rollers 103 and passes the reading position X, the second surface of the sheet P is read by the image reading unit. Then, when the sensor detects the trailing end of the sheet P after the second surface was read, the discharging roller 104 are stopped again with nipping the trailing end portion of the sheet P. Thereafter, the sheet is reversely fed in the bidirectional feed path 105. When the sheet P is re-enters the feeding path 102 from the bidirectional feed path 105, the leading end and the trailing end are exchanged again, i.e., the sheet P is oriented such that the first surface faces the reading position X. Then, the sheet P is fed in the feeding path 102 and discharged in an output tray 106 with the first surface being oriented downward (i.e., facedown discharge). With the above movement, both the first and second surfaces are read, and the sheets P are stacked on the output tray 106 in the order similar to the order the sheets P were stacked on the input tray 100.

The pickup roller 101, feed rollers 103 and discharge roller 104 are rotated as driving force is transmitted from a motor. Specifically, the pickup roller 101 and the feed rollers 103 are always rotated in a predetermined direction for feeding the sheet P forwardly (i.e., from the upstream side to the downstream side of the sheet feed path 102). The discharge rollers 104 are rotated either forwardly or reversely for bidirectional feed. For example, as shown in FIG. 18, when the sheet P is nipped by the feed rollers 103 and the discharge rollers 104, feeding directions of the feed rollers 103 and the discharge rollers 104 should coincide with each other. If the sheet P is nipped by the feed rollers 103 on immediately upstream side of the reading position X and the discharge rollers 104, the feeding direction of the feed rollers 103 on immediately upstream side of the reading position X and the discharge rollers 104 should coincide with each other.

SUMMARY OF THE INVENTION

The aspects of the invention is advantageous in that connection/disconnection of transmission of the driving force from a driving source to a switchback driving mechanism is ensured.

BRIEF DESCRIPTION OF ACCOMPANYING DRAWINGS

DESCRIPTION

General Overview

Figure 1:
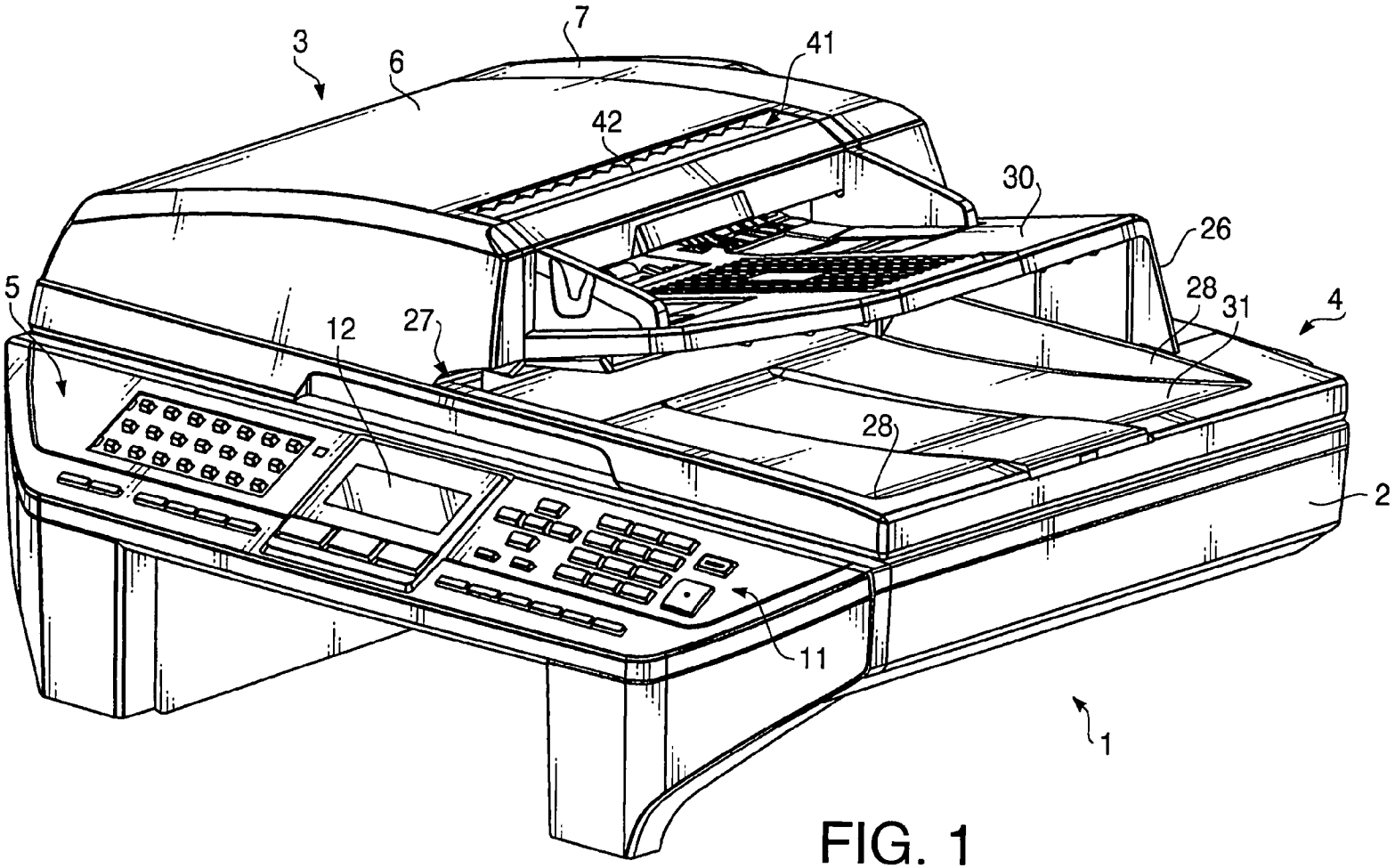
FIG. 1 is a perspective view of an image reading device according to aspects of the invention.

According to Illustrative aspects of the invention, there is provided a document feeder, provided with an input tray configured to receive a document; an output tray positioned one of above and below the input tray; a document transfer path extending an input tray and the output tray; transfer elements for transferring a document from the input tray to the output tray; a bidirectional feed path having both ends which are connected to predetermined positions of the document feeding path, respectively; a bidirectional feed system provided to the bidirectional feed path to feed the document from a downstream side of the image reading position to an upstream side of the image reading position with a leading end and a trailing end of the document being reversed; a drive system applying a driving force to the bidirectional feed system; a first transmitting assignment configured to transmit the driving force for feeding the document in a first direction to the bidirectional feed system in accordance with one of the forward and backward rotations, the first transmitting assignment transmitting the driving force for feeding the document in a second direction to the bidirectional feed system in accordance with the other one of the forward and backward rotations; a second transmitting assignment configured to cut off transmission of the driving force based on the rotation of the drive system is switched from one direction to the other, the transmission of the driving force being connected when an actuator is operated while the drive system is rotated in the other direction; and a controller configured to actuate the actuator of the connecting/disconnecting unit based on the drive system is rotated in the other direction, In accordance with the rotated amount of the drive system, the controller actuates the actuator by a predetermined period.

When the both-side reading is executed, the original document firstly passes through the reading position with its first side facing the image reading unit. After the first side is scanned, the original document is guided to the bidirectional feed path, where the bidirectional feed system is provided. The bidirectional feed system receives the driving force of the drive system via the first transmitting assignment, and feed the original document in the first direction or second direction in accordance with the rotation direction of the drive system. When the original document is introduced in the bidirectional feed path, the second transmitting assignment cuts off the transmission of the driving force via the first transmitting assignment. When the original document has entered the bidirectional feed path, the controlling unit connects the transmission of the drive system via the first transmitting assignment so that the bidirectional feed system feeds the original document in the second direction.

The drive system may include a single motor for driving the bidirectional feed system.

The controller may control the driving system to rotate in the direction corresponding to the second direction, and actuates the actuator at a predetermined timing. The actuator is for allowing the transmission of the driving force by the first transmitting assignment to transit from the disconnected state to the connected state. As the actuator is actuated for a predetermined period and the driving system is rotated in the opposite direction during the predetermined period, the transmission of the driving force by the first transmitting assignment is achieved, and the bidirectional feed system feeds the original document in the second direction.

The bidirectional feeding system feeds the original document passing through the reading position at a predetermined speed corresponding to the reading resolution. For example, if the reading resolution is set to high, since the amount of the image data increase and the image data requires a large capacity for storing the image data, the bidirectional feeding system may temporarily stop the feeding of the original document passing through the reading position. For temporarily stopping the feeding of the original document, the driving system may be stopped temporarily. If the driving system is stopped when the actuator is operating, connection of the transmission of the driving force via the first transmitting assignment may not be completed. Therefore, the controller may actuate the actuator if the amount of the rotation of the driving system when the actuator is operating is less than a predetermined amount. With this control, it is ensured that the connection of the transmission of the driving force via the first transmitting assignment is achieved.

The document feeder may be configured such that, if the rotating amount of the driving system within a period in which the actuator is actuated is less than the predetermined amount, the controller actuates the actuator after the driving system starts rotating in the other direction.

With this control, the driving system is rotating when the controller actuates the actuator. Therefore, it is ensured that the connection of the first transmitting assignment is achieved.

If the actuator is actuated by a plurality of times and the rotating amount of the driving system within the period during which the actuator is actuated is less than a predetermined amount, the controller notifies occurrence of an error status.

With this error notification, the user can recognize that the feed error has occurred during the bidirectional feed. Further, the original document will not be forcibly fed under a condition where the driving force is not transmitted via the first transmitting assignment. Therefore, the original document will not be broken in such a condition.

The document feeder may be configured such that the first transmitting assignment may include: a first transmission gear that receives the driving force from the drive source; a sun gear engaging with the transmission gear; a first planetary gear and a second planetary gear respectively engage with the sun gear; a second transmission gear which is engaged with one of the first planetary gear and the second planetary gear and transmits the driving force to the bidirectional feed system; a rotatable member configured to rotatable about the rotary axis of the sun gear, the rotatable member rotatably supporting the first planetary gear and the second planetary gear, rotation of the rotatable member in one direction making the first planetary gear disengage from the second transmission gear and making the second planetary gear engage with the second transmission gear, rotation of the rotatable in an opposite direction, which is opposite to the one direction, making the first planetary gear engage with the second transmission gear and making the second planetary gear disengage from the second transmission gear. The connecting/disconnecting unit may be configured to maintain a disengaged status where the first planetary gear and the second planetary gear are disengaged from the second transmission gear, the connecting/disconnecting unit including an engaging member that releases the engagement based on the operation of the actuator.

EMBODIMENT

Hereinafter, referring to the accompanying drawings, an image reading device according to aspects of the invention will be described. It should be noted that the image reading device described herein is only an exemplary embodiment, which can be modified in various ways without departing from scope of the invention.

Figure 2:
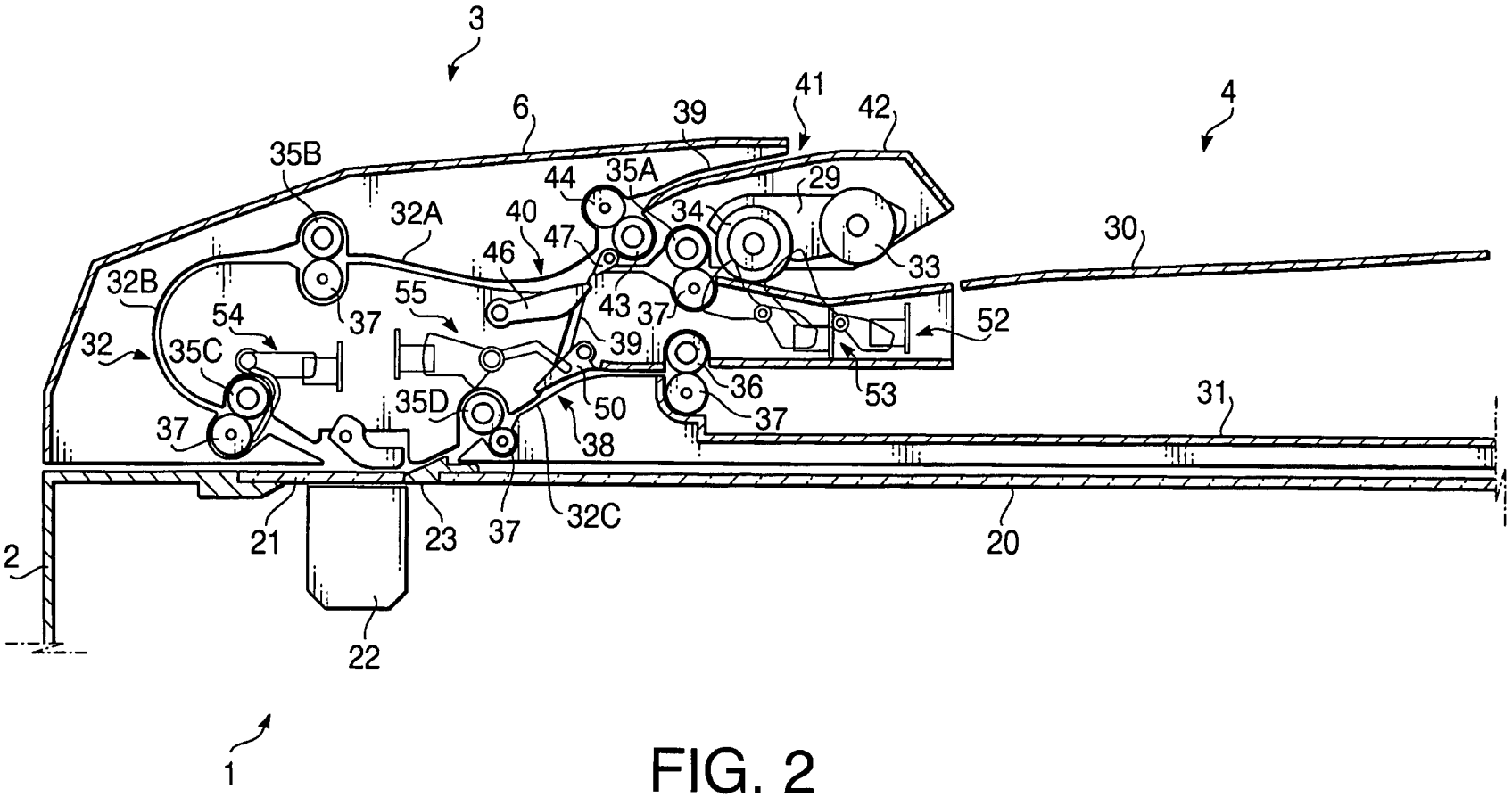
FIG. 2 is a cross-sectional side view schematically shows inner structure of the image reading device shown in FIG. 1.

FIG. 1 is a perspective view of an image reading device 1 according to aspects of the invention. FIG. 2 is a side view schematically showing an inner configuration of the image reading device 1 shown in FIG. 1. The image reading device 1 may be used as an image scanning unit of, for example, a copier, a facsimile machine, a scanner, and an MFD (Multi-Function Device) having copying function, facsimile function and scanner function, and the like.

As shown in FIGS. 1 and 2, the image reading device 1 is configured such that, on a document table 2 that functions as an FBS (Flatbed Scanner), a document cover 4 provided with an ADF (Auto Document Feeder) 3 is attached. The document cover 4 is openably attached to the document table 2 at a rear portion (a rear direction being in a backside direction with respect a plane of FIG. 1) thereof with a hinge mechanism so as to be opened/closed with respect to the document table 2.

On a front side of the document table 2, an operation panel 5 is provided. The operation panel 5 is provided with various operation keys 11 and an LCD (Liquid Crystal Display) unit 12. A user of the image reading device 1 may input a desired instruction using the operation panel 5. For example, a "START" command to start reading operation to read documents, a "STOP" command to stop the reading operation, and a selection of both-side reading mode or a one-side reading mode can be input using the operation keys 11. The image reading device 1 operates in accordance with the thus input operation commands. It should be noted that the image reading device 1 can be connected to a computer (not shown) and operate in accordance with instructions transmitted from the computer under control of a printer driver, a scanner driver or the like, in addition to the operation input through the operation panel 5.

On the document table 2, on a surface facing the document cover 4, platen glasses 20 and 21 are arranged as shown in FIG. 2. When the document cover 4 is opened, the platen glasses 20 and 21 are exposed to outside as an upper surface of the document table 2. When the document cover 4 is closed, it covers an entire upper surface, including the platen glasses 20 and 21, of the document table 2. Inside the document table 2, an image reading unit 22 is accommodated to face the platen glasses 20 and 21.

When the image reading device 1 is used as the FBS, the document is placed on the platen glass 20. The platen glass 20 is formed of, for example, a transparent colorless glass plate. At a central area of the upper surface of the document table 2, an opening that exposes the platen glass 20 to outside is formed. The area of the platen glass 20 exposed through the opening serves as an image reading area of the FBS.

The platen glass 21 is located at a reading position when the ADF 3 is used. The platen glass 21 is formed of a transparent colorless glass plate. At the reading position of the document table 2, an opening that exposes the platen glass 21 to outside is formed. The platen glass 21 exposed through the opening is elongated in the depth direction (from front to rear direction) of the image reading device 1 by a amount corresponding to the length of the image reading unit 22 in a main scanning direction.

Between the platen glass 20 and the platen glass 21, an positioning member 23 is provided. The positioning member 23 is, similar to the platen glass 21, a plate member elongated in the depth direction of the image reading device 1. The positioning member 23 is used as a reference member when a document is placed on the platen glass 20, which is the document placing table when the image reading device is used as the FBS. For this purpose, on the upper surface of the positioning member 23, marks indicating both ends of various sizes of sheets (A4 size, B5 size, etc.) and a central position thereof. On the upper surface of the positioning member 23, a guiding surface for deflecting (catch up) the sheet passed through the platen glass by the ADF 3 is formed.

The image reading unit 22 is an image sensor which is configured to illuminate the document to be scanned with light emitted by the light source and incident on the document through the platen glass 20 or 21, and receives the light reflected by the document through a lens and converts the received optical image into an electric signal. As the image reading unit 22, a CIS (Contact Image Sensor), CCD (Charge Coupled Device) provided with an reducing optical system, and the like can be used. The image reading unit 22 is configured to reciprocally moves below the platen glasses 20 and 21 by a belt-drive mechanism. A driving force of a carriage motor drives the belt-drive mechanism so as to reciprocally move the image reading unit 22 in parallel with the surface of the platen glasses.

The document cover 4 is provided with the ADF 3 that consecutively feeds the document P from a input tray 30 to a output tray 31 via a document feed path 32. When the document P is fed by the ADF 3, the document P passes through the image reading unit of the platen glass 21, which is scanned by the image reading unit 22 located beneath the platen glass 21.

As shown in FIGS. 1 and 2, the input tray 30 and the output tray 31 are provided to the document cover 4. The output tray 31 positioned one of above and below the input tray 30. In the input tray 30, the documents to be scanned by the ADF 3 are placed. Specifically, a plurality of document sheets to be scanned by the ADF 3 are stacked with the first surface is oriented upside and the leading end in the sheet feed direction is directed to the document feed path 32. As the rear side portion of the input tray 30 is bent downward, thereby a protecting wall 26 is formed. The lower end of the protecting wall 26 is connected to the upper surface of the document cover 4. The protecting wall 26 prevents the document placed on the output tray 31 from dropping therefrom when the document cover 4 is opened. Below a front side portion of the input tray 30, a cutout 27 is formed on a part of a casing of the ADF 3. The cutout 27 enables a user to view the discharged documents from the front side of the image reading device 1. In particular, when the size of the document is small, it is difficult to view the document discharged in the output tray 31. According to the embodiment, the cutout 27 widen a space between the input tray 30 and the output tray 31, even the document having a small size can be viewed from the front side of the image reading device 1.

The output tray 31 is located below the input tray 30 with a certain clearance therebetween, and formed integrally with the upper surface of the document cover 4. The document discharged from the ADF 3 after image reading operation thereto is finished is held by the output tray 31 with the first surface thereof being oriented downward, separated from the document in the input tray 30. Side portions 28 (i.e., a front side portion, and a rear side portion) of the output tray 31 are formed as inclined surfaces inclined upward toward both ends. As the side portions 28 are formed, the document discharge on the output tray 31 can be picked up by pressing the document from the above and sliding the document along the inclined surfaces 28 at both end portions. Thus, the document can be picked up from the output tray 31 easily.

As shown in FIG. 2, inside the ADF 3, the document feed path 32 is formed. The document feed path 32 extends to form a U-shape, in a cross section taken along a plane perpendicular to a front-to-rear direction. The document feed path 32 connects the input tray 30 and output tray 31 via the reading position defined on the platen glass 21. The document feed path 32 is formed as a continuous path defined by components of the ADF, guide plates, guide ribs and the like. The document feed path 32 has a predetermined width allowing the document to pass through. As above, since the input tray 30 and the output tray 31 are arranged in the up-and-down direction, and the U-shaped feed path 32 is defined to connect the input tray 30 and the output tray 31, the width of the ADF 3 can be lessened, which contributes to downsizing of the entire device 1.

The document path 32 extends from the input tray 30 toward one end side of the document cover 4 (toward the left-hand side end in FIG. 2), bent downward and further bent so that the document is reversed and reaches the reading position on the platen glass 21. The document path 32 further extends from the reading position to the output tray 31. Thus, the document path 32 is roughly divided into three portions: a substantially linear upper portion 32A and a substantially liner lower portion 32C, and a curved portion 32B connecting the upper linear portion 32A and the lower linear portion 32C. The document path 32 is used as a path of the document in either case where only one side of a sheet is read or both sides of a sheet are read.

As shown in FIG. 2, at the most upstream portion of the document path 32, a pickup roller 33 and a separation roller 34 are provided. The pickup roller 33 is provided at a tip portion of an arm 29, a proximal end portion of which is supported by a shaft which also supports the separation roller 34. The separation roller 34 is provided at a position spaced from the pickup roller 33 in the feeding direction such that it contacts an opposing surface of the feed path 32. Both the pickup roller 33 and the separation roller 34 are driven to rotate by the driving force transmitted from a motor 67. The arm 29 is also driven by the driving force from the motor 67 to move up and down. The diameters of the pickup roller 33 and the separation roller 34 are the same and driven to rotate at the same speed. At an opposed position of the separation roller 34, a separation pad is provided. The separation roller 34 is urged to contact the separation pad, and separates the individual sheet of the document by friction.

Feed rollers 35A, 35B, 35C and 35D are arranged at different positions of the feed path 32. According to aspects of the invention, the feed roller 35A is provided immediately downstream side of the separation roller 34. The feed roller 35B is provided at the upper portion 32A of the feed path 32. The feed roller 35C is provided at a position immediately upstream side of the reading position and on the lower portion 32C of the feed path 32. The feed roller 35D is provided at a position immediately downstream side of the reading position and on the lower portion 32C of the feed path 32. It should be noted that the above is an exemplary arrangement and the number of the feed rollers 35A, 35B, 35C and 35D and/or arranged positions thereof can be modified in various ways.

At positions opposite to the feed rollers 35A, 35B, 35C and 35D, pinch rollers 37 are provided. The pinch rollers 37 are configured such that the rotary shafts are biased, with springs, toward the feed rollers 35A, 35B, 35C and 35D, respectively, so that the pinch rollers are press-contacted with the feed rollers 35A, 35B, 35C and 35D, respectively. Thus, when the feed rollers 35A, 35B, 35C and 35D rotate, the pinch rollers 37 are driven thereby to rotate. When a sheet of the document is located at the feed rollers 35A, 35B, 35C and 35D, the sheet is press-contacted with the feed rollers 35A, 35B, 35C and 35D by the pinch rollers 37. Thus, the rotational force of the feed rollers 35A, 35B, 35C and 35D is transmitted to the sheet of the document.

The discharge roller 36 is arranged at the most downstream side of the feed path 32. Similar to the feed rollers 35A-35D, the driving force of the motor is transmitted to the discharge roller 36, thereby the discharge roller 36 rotates. At a position opposite to the discharge roller 36, the pinch roller 37 is provided. The pinch roller 37 is biased toward the discharge roller 36 by a spring.

At a connecting position 38 of the feed path 32 where the lower portion 32C is connected to a bidirectional feed path 39. The bidirectional feed path 39 is used for both-side reading. After the first surface of the sheet is read at the reading position, the leading end and the trailing end of the sheet is reversed (i.e., orientation of the sheet is reversed), and is fed from the downstream side of the reading position to the upstream side of the reading position. The bidirectional feed path 39 extends obliquely from the connected position 38 toward a position above the input tray 30 and intersects with the upper portion 32A of the feed path 32 at an intersecting position 40. The sheet is re-entered from the bidirectional feed path 39 into the feed path 32 at the intersecting position 40.

The end position 41 of the bidirectional feed path 39 is opened on the upper surface of the ADF 3. On the input tray 30 side with respect to the end position 41 of the bidirectional feed path 39, a document supporting unit 42 is formed so as to be connected from the end position 41. The document supporting unit 42 is for supporting the sheet protruded from the end position 41 of the bidirectional feed path 39, and serves as a part of an upper cover 6 for the ADF 3 at a position above the pickup roller 33 and the separation roller 34. The upper cover 6 is configured to cover the entire are of the ADF 3 including the pickup roller 33 and the separation roller 34, and is openable. The document supporting unit 42 formed as a part of the upper cover 6 extends from the end position 41 toward the input tray 30 so that it covers a position upstream side of the sheet feed position defined by the pickup roller 33 and the separation roller 34. With this configuration, when the both-side reading is executed, the sheet entered the bidirectional feed path 39 and protruded from the end position 41 of the bidirectional feed path 39 to outside the ADF 3 is supported on the document supporting unit 42. Therefore, the sheet supported by the document supporting unit 42 will not hang down beneath the downstream side (i.e., the left-hand side in the figure) with respect to the feed position of the documents stacked on the input tray 30. Therefore, the documents will not be disturbed at the feeding position. Further, when the upper cover 6 is opened, a part of the feed path and bidirectional feed path 39 inside the ADF 3 are exposed to outside, which eases maintenance of the ADF 3, such as a sheet jam.

On an immediately downstream side (i.e., the end position 41 side) with respect to the intersecting position 40 of the bidirectional feed path 39, a reversible roller 43 is provided. The reversible roller 43 is rotated in forward/reverse direction by the driving force transmitted from the motor 67. At a position opposite to the reversible roller 43, a pinch roller 44 is arranged. The pinch roller 44 is configured such that the shaft thereof is biased by a spring and the pinch roller 44 is press-contacted with respect to a roller surface of the reversible roller 43. The pinch roller 44 is driven to rotate as the reversible roller 43 rotates.

It should be noted that, in the exemplary embodiment described above, the bidirectional feed path 39 is formed as above, the configuration of the bidirectional feed path 39 can be modified in various ways. That is, if connected to a predetermined position of the feed path 32 and the sheet is returned to the upstream side in the feed path of the reading position with reversing the leading end and trailing end of the sheet, any configuration of the bidirectional feed path can be applicable.

As shown in FIG. 2, at the intersecting position 40, a guide flap 46 and a guide flap 47 are provided for guiding the document. Specifically, the guide flap 46 is pivotably supported about an axis which is located at a corner defined by the reading position side of the feed path 32 with respect to the intersecting position 40 and the connecting position 38 side of the bidirectional feed path 39 with respect to the intersecting position 40. The guide flap 46 is pivotable within a predetermined angular range. The guide flap 46 is a feather-shaped plate member (blade member), and the top thereof is protruded toward the intersecting position 40. In FIG. 2 and the above description, only a single guide flap 46 is indicated. However, there are a plurality of guide flaps 46 of the same structure along a width direction (i.e., a direction perpendicular to a plane of FIG. 2) at every predetermined interval, and the plurality of guide flaps 46 are integrally moved.

The guide flaps 46 are pivotable in upward direction in FIG. 2 with respect to the position indicated in FIG. 2. Further, the guide flaps 46 are prevented from pivoting downward with respect to the position indicated in FIG. 2 by, for example, guide members provided to the bidirectional feed path 39. When the guide flaps 46 are located at the position shown in FIG. 2, the input tray 30 side portion (i.e., the right-hand side portion in FIG. 2) of the feed path 32 and reading position side (i.e., the left-hand side portion) of the feed path 32 are connected at the intersecting position 40. Further, a path from the sheet feed path 32 toward the connecting position 38 of the bidirectional feed path 39 is closed. Therefore, the document fed from the input tray 30 and reaches the intersecting position 40 is allowed to proceed toward the reading position side of the feed path 32, which prevented from entering the bidirectional feed path 39 toward the connecting position 38.

When the guide flaps 46 are pivoted upward in FIG. 2, a path from the connecting position 38 of the bidirectional feed path 39 to the end position 41 are connected, and a path from the connecting position 38 of the bidirectional feed path to the reading position of the feed path 32 is closed. In this state, the document fed from the connecting position 38 of the bidirectional feed path 39 to the intersecting position 40 is allowed to enter a path toward the end position 41 of the bidirectional feed path 39, while prevented from proceeding toward the reading position side of the feed path 32.

The guide flaps 46 are pivoted upward as the document contacts und pushes up the guide flaps 46. The guide flaps 46 are neutrally located at the position indicated in FIG. 2 with their own weights or by a biasing force of elastic members such as springs. When the document fed from the connecting position 38 of the bidirectional feed path 39 to the intersecting position 40 contacts the guide flaps 46, the guide flaps 46 are pushed up and pivot counterclockwise in FIG. 2. Thus, the document is further fed toward the end position 41 of the bidirectional feed path 39. Thereafter, the document is reversely fed from the end position 41 of the bidirectional feed path 39. When the document is fed from the end position 41 to the intersecting position 40, the document again contacts the guide flaps 46. As described above, the guide flaps 46 are configured such that they do not rotate downward with respect to the position shown in FIG. 2. Therefore, the document is guided by the guide flaps 46 and proceeds along the upper portion 32A of the feed path 32 toward the reading position. It should be noted that each guide flap 46 is shaped so that the guide flap 46 can be moved upward (in FIG. 2) as the document fed from the connecting position 38 contacts the same, and the document fed from the end position 41 of the bidirectional feed path 39 can be directed to the reading position side of the feed path easily. With the above configuration, that is, by forming the guide flaps 46 to change the attitude as the document contact the guide flaps 46, it is unnecessary to apply the driving force of the motor 67. Therefore, the structure of the guide flaps 46 can be simplified.

The guide flap 47 is pivotably supported about an axis which is located at a corner defined by the input tray 30 side of the feed path 32 with respect to the intersecting position 40 and the end position 41 side of the bidirectional feed path 39 with respect to the intersecting position 40. The guide flap 47 is pivotable within a predetermined angular range. The guide flap 47 is a feather-shaped plate member (blade member), and the top thereof is protruded toward the intersecting position 40. In FIG. 2 and the above description, only a single guide flap 47 is indicated. However, there are a plurality of guide flaps 47 of the same structure along a width direction (i.e., a direction perpendicular to a plane of FIG. 2) at every predetermined interval, and the plurality of guide flaps 47 are integrally moved.

In the exemplary embodiment shown in FIG. 2, the guide flaps 47 are pivotable leftward (i.e., counterclockwise in FIG. 2) with respect to the position indicated in FIG. 2. The guide flaps 47 are prevented from being rotated rightward with respect to the position thereof shown in FIG. 2. When the guide flaps 47 are located at position shown in FIG. 2, a feed path from the end position 41 of the bidirectional feed path 39 and a path on the reading position side of the feed path 32 are connected, while a path from the connecting position 38 of the bidirectional feed path 39 to the input tray 30 side of the feed path 32 is closed. With this configuration, the document fed from the end position 41 of the bidirectional feed path 39 to the intersecting position 40 is allowed to proceed toward the reading position side of the feed path 32. The document is prevented from entering the input tray 30 side of the feed path 32. The document fed from the connecting position 38 of the bidirectional feed path 39 to the intersecting position 40 is allowed to proceed toward the end position 41 of the bidirectional feed path 39, while prevented from proceeding toward the input tray 30 side of the feed path 32.

When the guide flaps 47 are rotated leftward (i.e., clockwise in FIG. 2), a portion of the feed path on the input tray 30 side and a path toward the reading position side are connected, while the path from the input tray 30 side of the feed path 32 to the end position 41 of the bidirectional feed path 39 is closed. With this state, the document fed from the input tray 30 to the intersecting position 40 is allowed to proceed toward the reading position side of the feed path 32, while prevented from proceeding toward the end position 41 side of the bidirectional feed path 39.

The guide flaps 47 are moved upward (i.e., clockwise) as the document contacts and pushes the guide flaps 47 leftward. The guide flaps 47 are neutrally located at the position indicated in FIG. 2 with their own weights or by a biasing force of elastic members such as springs. When the document fed from the input tray 30 contacts the guide flaps 47, the guide flaps 47 are pushed up and move clockwise in FIG. 2. Thus, the document is further fed toward the upper portion 32A of the feed path 32. When the document is fed from the connecting position 38 of the bidirectional feed path 39 to the intersecting position 40 contacts the guide flaps 47, they are prevented from rotating rightward with respect to the position shown in FIG. 2, and thus the document is guided by the guide flaps 47 and enters the end position 41 side of the bidirectional feed path 39. It should be noted that each guide flap 47 is shaped so that the guide flap 47 can be moved easily when the document fed from the input tray 30 contacts the same, and the document fed from connecting position 38 toward the intersecting position 40 of the bidirectional feed path 39 can be directed to the end position 41 side of the bidirectional feed path 39 easily. With the above configuration, that is, by forming the guide flaps 47 to change the attitude as the document contact the guide flaps 47, it is unnecessary to apply the driving force of the motor 67. Therefore, the structure of the guide flaps 47 can be simplified.

As shown in FIG. 2, a guide flap 50 is provided at the connecting position 38. The guide flap 50 is pivotable about an axis located at a position between the feed path 32 and the bidirectional feed path 39. The guide flap 50 is driven by the driving force transmitted from the motor 67 to rotate downward with respect the position indicated in FIG. 2. According to the exemplary embodiment, the guide flap 50 is prevented from moving upward with respect to the position shown in FIG. 2 by, for example, guide members of the feed path 32 and/or the bidirectional feed path 39. The guide flap 50 can move downward so that document is guided to the bidirectional feed path 39. When the guide flap 50 is located at the position shown in FIG. 2, a portion of the feed path on the reading position with respect to the connecting position 38 and a portion of the feed path on the output tray 31 side are connected. With this state, the document passed through the reading position proceeds along the lower portion 32C of the feed path 32, passes through the connecting position 38 and is guided toward the output tray 31. When the guide flap 50 is moved downward with respect to the position shown in FIG. 2, a part of the lower portion 32C on the downstream side of the reading position and a path toward the bidirectional feed path 39 are connected. Then the document passed through the reading position is guided to enter the bidirectional feed path 39. As above, the guide flap 50 guides the document to either of the feed path 32 or the bidirectional feed path 39 at the connecting position 38. In FIG. 2, only one guide flap 50 is shown. However, according to the exemplary embodiment, a plurality of the same guide flap 50 are provided, which are aligned along the width direction of the feed path 32 at every predetermined interval, which are driven to rotate integrally.

As shown in FIG. 2, in the feed path 32 and the bidirectional feed path 39, a plurality of sensors for detecting the feeding condition of the document are provided. Specifically, in the feed path 32, a first front sensor 52 and a second front sensor 53 are providing on the upstream side and downstream side with respect to the separation roller 34. On the immediate upstream side of the reading position, a read sensor 54 is provided. Between the connecting position 38 of the bidirectional feed path 39 and intersecting position 40, a sensor 55 is provided. These sensors are optical sensors (e.g., photo interrupters) which detect a detection piece protruding to/retracted from the feed path 32 of the bidirectional feed path 39.

When the document is placed on the input tray 30, the first front sensor 52 is turned ON. That is, based on the ON/OFF state of the first sensor, whether the document is placed on the input tray 30 can be detected. The second front sensor 53 provided at immediate downstream side of the separation roller 34 is turned ON/OFF to detect the leading end and trailing end of the document fed in the feed path 32. For example, by investigating the number of rotations of the feed rollers 35A, 35B, 35C and 35D and/or the number of driving steps applied to the motor 67 after detection of the trailing end of the document by the second front sensor 53, position of the leading end or trailing end of the document in the feed path 32 can be determined.

The read sensor 54 provided at a position on immediate upstream side with respect to the reading position is for detecting the leading end and/or trailing end of the document fed in the feed path 32 based on the ON/OFF state thereof. For example, by monitoring the number of rotations of the feed rollers 35A, 35B, 35C and 35D and/or the number of driving steps applied to the motor 67 after detection of the leading end or trailing end of the document by the read sensor 54, whether the leading end or trailing end of the document has reached the reading position is judged. When the leading end has reached the reading position, the image reading operation is started, and when the trailing end has reached the reading position, the image reading operation is finished.

The sensor 55 provided between the connecting position 38 and the intersecting position 40 is for detecting the leading end or trailing end of the document based on the ON/OFF state thereof. For example, by monitoring the number of rotations of the feed rollers 35A, 35B, 35C and 35D and/or the number of driving steps applied to the motor 67 after detection of the leading end or trailing end of the document by the sensor 55, whether the trailing end of the document has passed the intersecting position 40 is judged. By arranging the sensor 55 at a position on the upstream side and relatively close to the reversible roller 43, accuracy in feeding amount can be improved in comparison with a case where a position of the trailing end of the document is monitored based on the detection signal of the read sensor 54.

Figure 3:
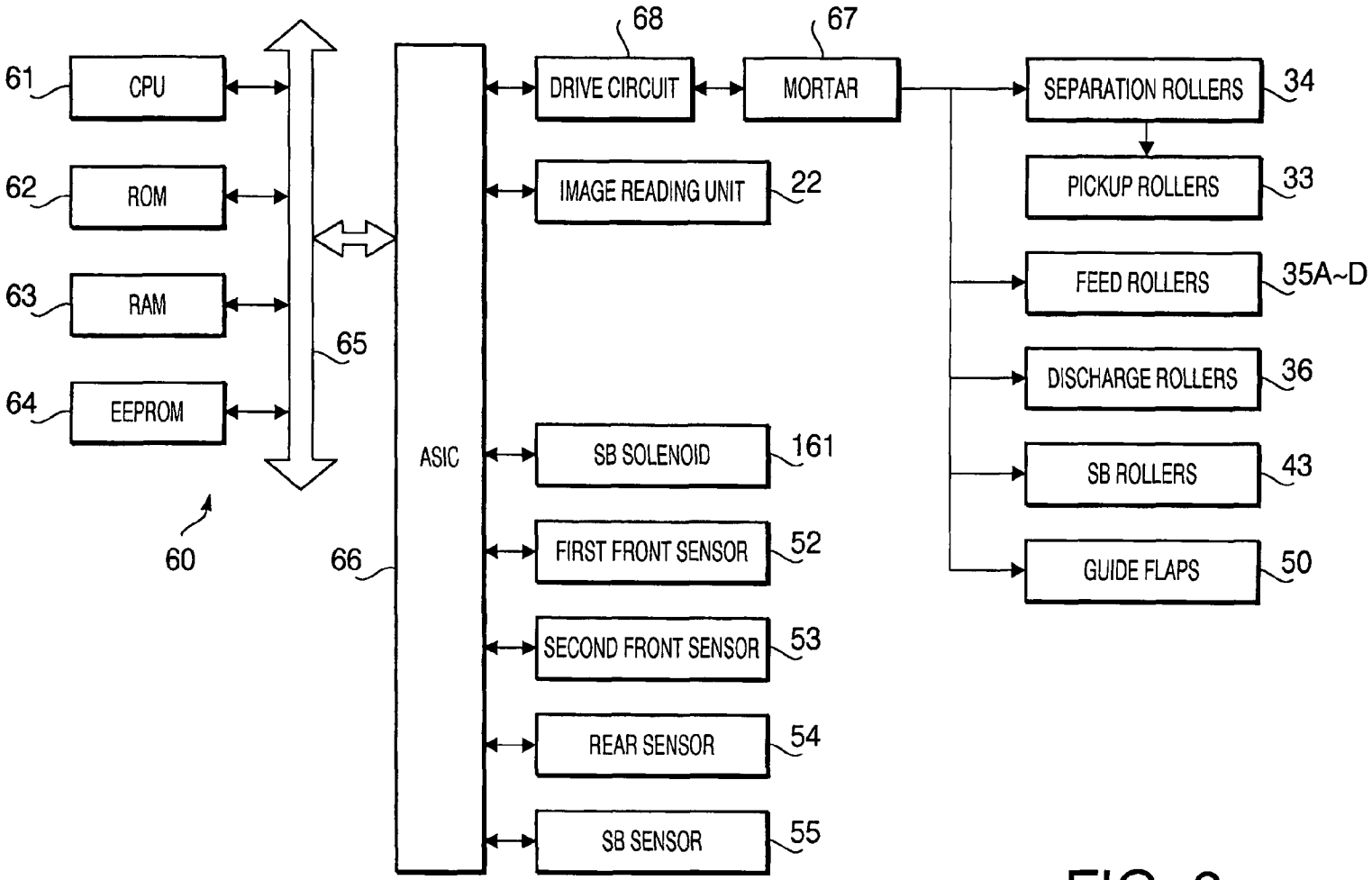
FIG. 3 is a block diagram showing a configuration of a control unit of the image reading device according to aspects of the invention.

FIG. 3 shows a configuration of a control unit 60 of the image reading device 1. The control unit 60 is configured to control not only the operation of the ADF 3 but the entire operation of the image reading device 1. The control unit 60 is configured as a microcomputer provided with, as shown in FIG. 3, a CPU 61, a ROM 62, a RAM 63, an EEPROM (Electrically Erasable and Programmable ROM) 64, which are connected with an ASIC (Application Specific Integrated Circuit) 66 via a bus 65.

The ROM 62 stores programs for controlling operations of image reading device 1 and ADF 3. The RAM 63 is used as a storage for temporarily stores data and/or work area when the CPU 61 executes the programs stored in the ROM 62. The EEPROM 64 is non-volatile storage and stores various setting parameters and flags to be held after the image reading device 1 is powered OFF.

The ASIC 66 controls the rotation of the motor 67. Specifically, the ASIC 66 generates phase excitation signal to be applied to the motor 67 in accordance with the instructions issued by the CPU 61, and applies the signal to a driving circuit 68. Then, the driving circuit 68 supplies a drive signal to the motor 67. The motor 67 can be forwardly or reversely rotated to supply driving forces to the pickup roller 33, separation roller 34, feed rollers 35A-35D, discharge roller 36, reversible roller 43 and guide flaps 50. It is noted that the ASIC 66 is the single driving source in the ADF 3.

The driving circuit 68 is for driving the motor 67. The driving circuit 68 receives the output signal of the ASIC 66, and generates electric signal for driving the motor 67 to rotate. The motor 67, then, receives the electric signal from the driving circuit 68 to rotate. The rotational force of the motor 67 is transmitted via respective driving force transmitting mechanisms to the pickup roller 33, separation roller 34, feed rollers 35A-35D, discharge roller 36, reversible roller 43 and guide flaps 50.

The ASIC 66 is connected with the image reading unit 22 which read the image on the document fed by the ADF 3 to the reading position. The image reading unit 22 reads the image on the document in accordance with the control programs stored in the ROM 62. Although not shown in figures, there is a mechanism that moves the image reading unit 22 reciprocally, which is also driven to move based on the output signal of the ASIC 66.

The ASIC 66 is connected with the first front sensor 52, the second front sensor 53, the read sensor 54 and the sensor 55. The CPU 61 receives the ON/OFF stats of theses sensors, and based on the control program stored in the ROM 62, controls the ASIC 66 to output predetermined signals to drive the motor 67 and/or image reading unit 22.

The ASIC 66 is connected with a solenoid 161. The solenoid 161 is for controlling transmission of the driving force from the motor 67 to the reversible roller 43. The mechanism for transmitting the driving force from the motor 67 to the reversible roller 43 will be described in detail. The CPU 61 controls the ASIC 66, based on the control program stored in the ROM 62, to output the output signal at predetermined timing to operate the solenoid 161.

Hereinafter, the driving force transmission mechanism from the motor 67 to the reversible roller 43 will be described. It should be note that, from the motor 67, the driving force is transmitted to each of the pickup roller 33, separation roller 34, feed rollers 35A-35D, discharge roller 36, and the guide flaps 50 through respective transmission mechanisms. However, such mechanisms are not directly related to the invention, and description thereof is omitted for brevity. Further, a rotary shaft of the reversible roller 43 extends in the width direction of the feed path 32, and the reversible roller 43 is configured to have a plurality of rollers having shorter than the width of the feed path 32, arranged at predetermined positions of the rotary shaft. It is of course possible to use a single roller which extends substantially over the entire width of the feed path 32. Alternatively, at a central portion in the width direction of the feed path 32, a relatively short roller may be provide as the single reversible roller 43.

The ADF 3 provided on the upper surface of the document cover 4 accommodates the feed path 32 and respective rollers in the casing thereof. The motor 67 and driving force transmission mechanisms are also accommodated in the casing of the ADF 3. The motor 67 and the driving force transmitting mechanisms are provided at one side end portion in the width direction of the feed path 32. At one side end portions of the rotary shafts of the separation roller 34, feed rollers 35A-35D, discharge roller 36, reversible roller 43 and guide flaps 50, driven gears are secured, respectively. From the motor 67, the driving forces are transmitted to the driven gears via the driving force transmitting mechanisms, respectively, thereby the rollers are driven to rotate. According to the exemplary embodiment, the motor 67, the driving force transmitting mechanisms, the driven gears secured to the side end portions of the rotary shafts of the separation roller 34, the feed rollers 35A-35D, discharge roller 36, reversible roller 43 and guide flaps 50 are accommodated in a space 7 defined at a rear portion of the casing of the ADF 3. Each of the gears described below is, unless particularly indicated, a spur gear having a disk-like shape with teeth whose ridges extend in the axial direction being formed on its peripheral.

Figure 4:
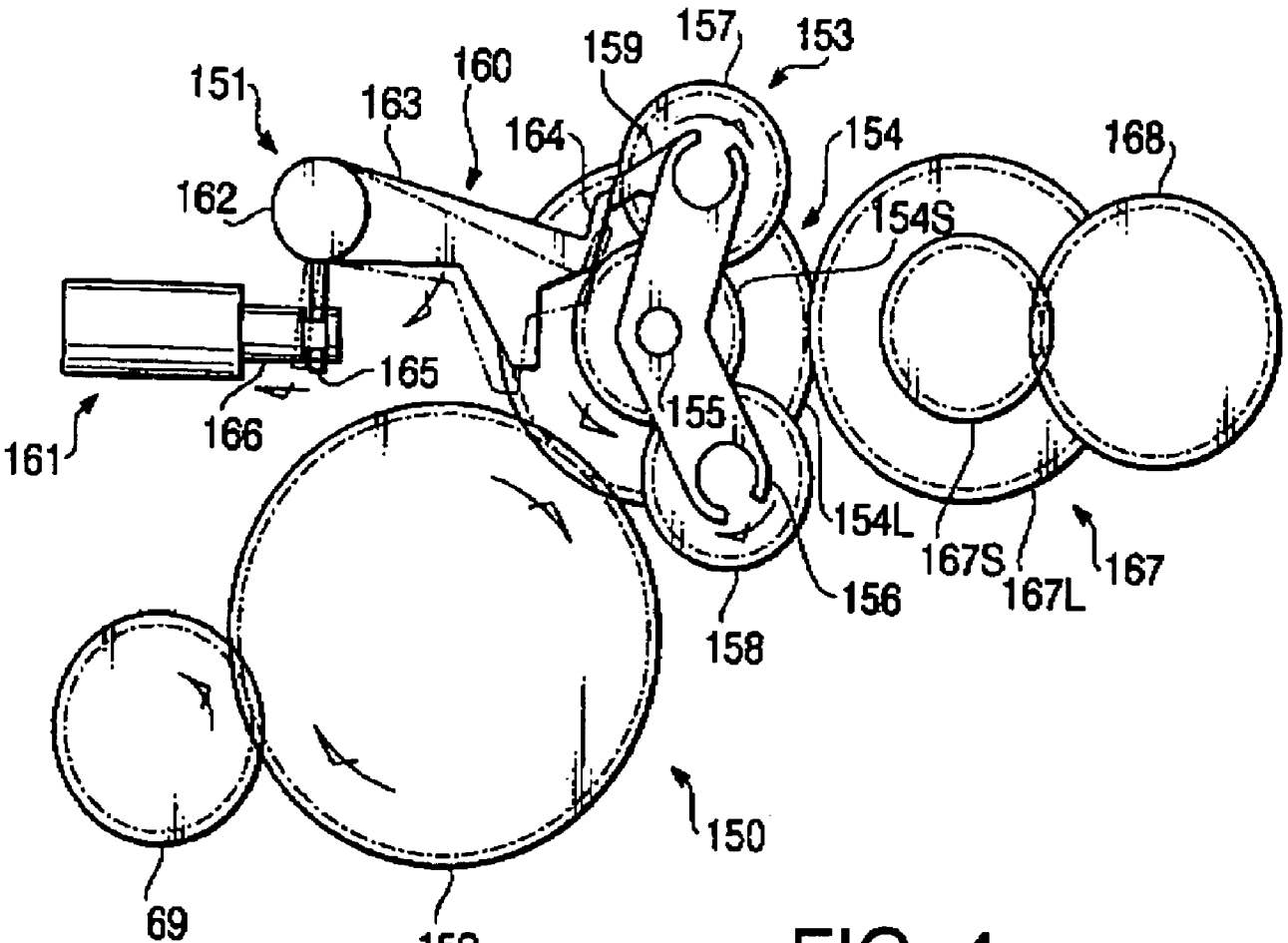
FIG. 4 is a side view schematically showing a structure of a driving force transmitting mechanism according to aspects of the invention.
Figure 5:
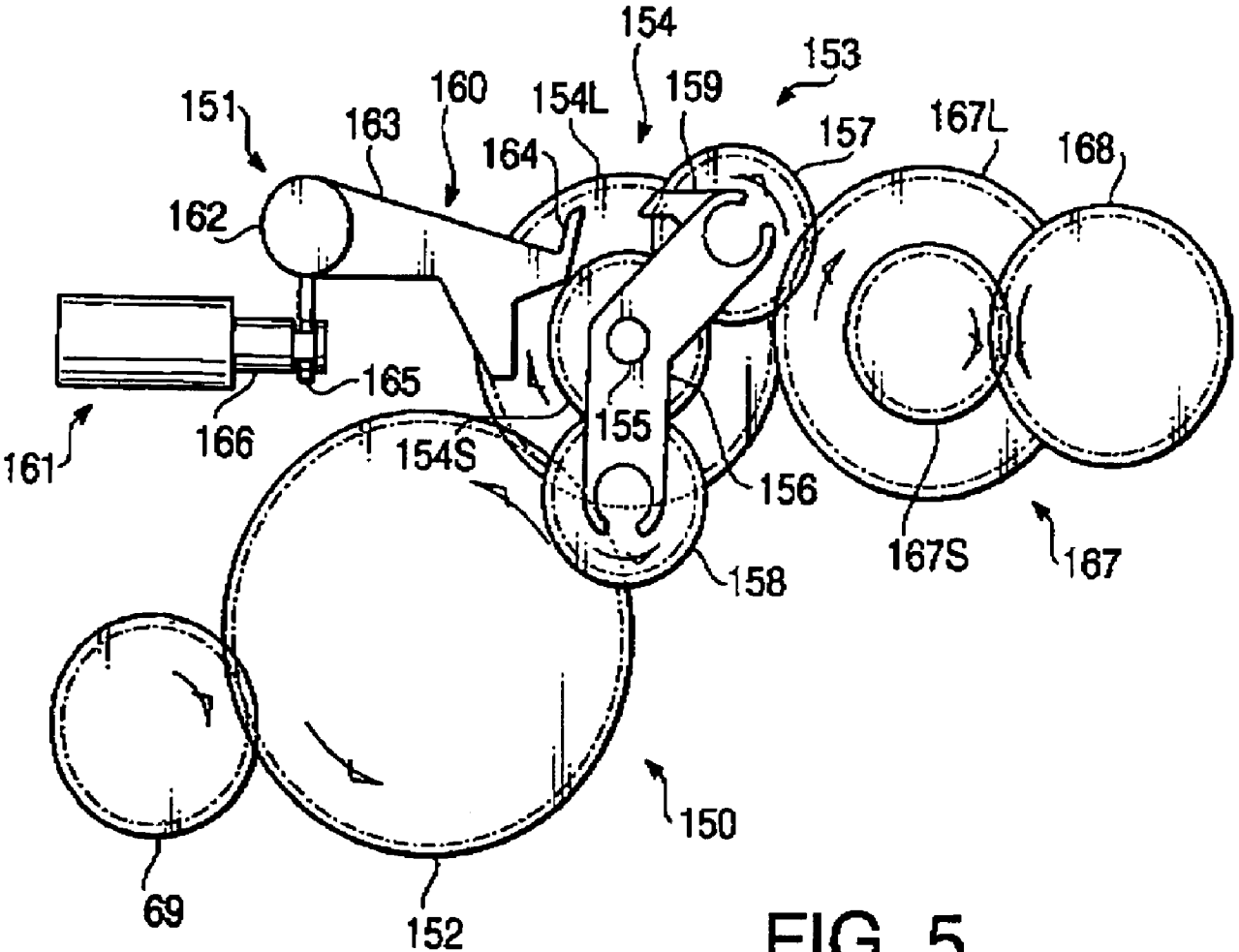
FIG. 5 is a side view schematically showing a structure of a driving force transmitting mechanism according to aspects of the invention.
Figure 6:
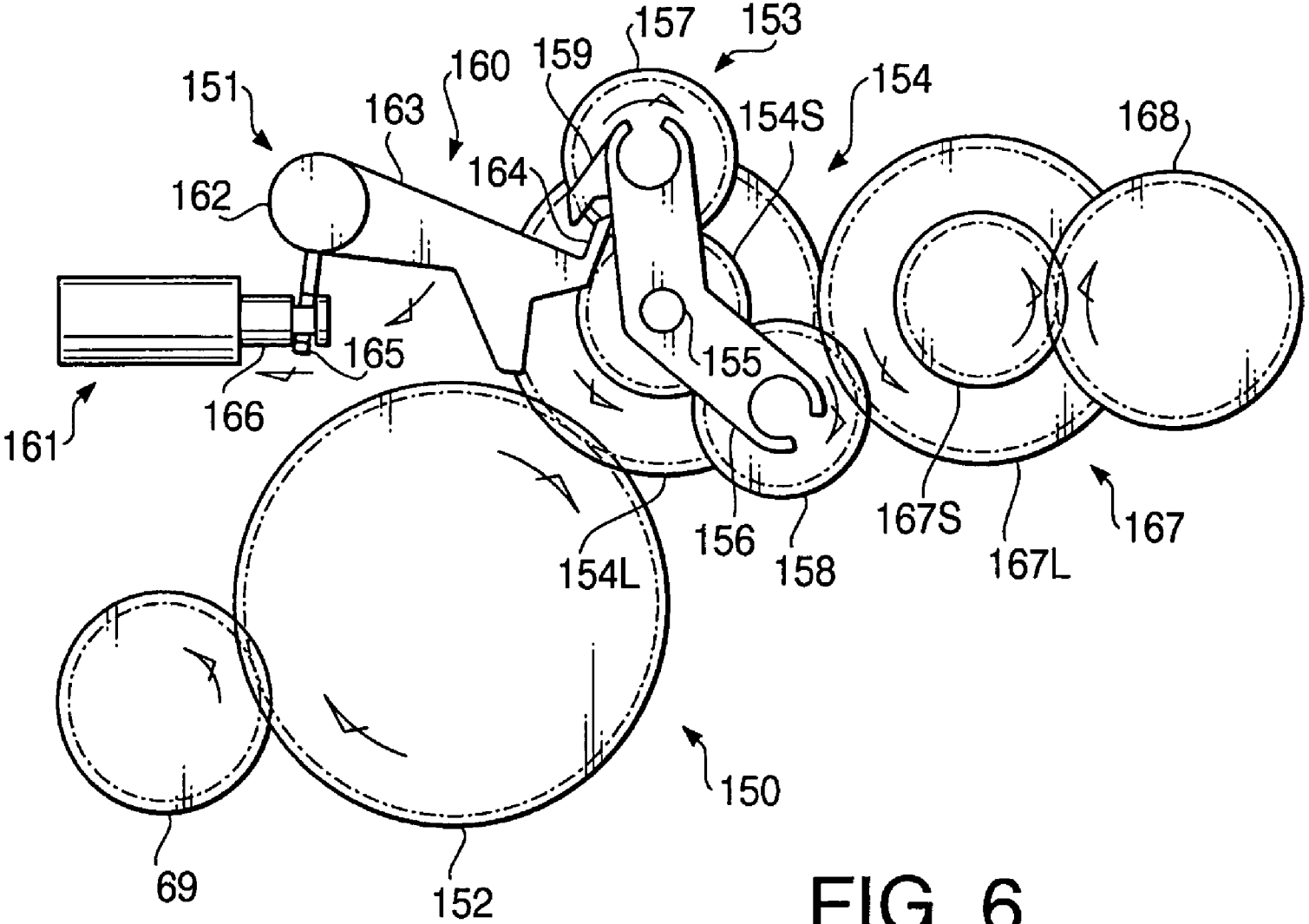
FIG. 6 is a side view schematically showing a structure of a driving force transmitting mechanism according to aspects of the invention.

FIGS. 4-6 show a driving force transmitting mechanism 150 and a connecting/disconnecting mechanism 151 for transmitting the driving force of the motor 67 to the reversible roller 43. The driving force transmitting mechanism 150 transmits, depending on whether the motor 67 rotates in CW (clockwise) direction or CCW (counterclockwise) direction, driving force in a drawing direction or returning direction to the reversible roller 43. The connecting/disconnecting mechanism 151 disconnects the transmission of the driving force from the motor 67 to the reversible roller 43 when the rotation direction of the motor 67 is switched from a direction corresponding to the rotation of the reversible roller 43 in the returning direction to a direction corresponding to the rotation of the reversible roller 43 in the drawing direction. It should be noted that the CW direction and the CCW direction are opposite rotation directions of the motor 67, and correspond to the forward and reverse rotations, respectively. The drawing direction is a direction in which the document is drawn from the feed path 32 to the bidirectional feed path 39, and the returning direction is a direction in which the document is returned from the bidirectional feed path 39 to the feed path 32.

As shown in FIG. 4, a driving gear 69 secured to an output shaft of the motor 67 engages with a first gear (transmission gear) 152, and the driving force is transmitted to a planetary gear unit 153. Upon CW rotation of CCW rotation of the motor 67, the driving force is transmitted such that the transmission gear 152 makes CCW rotation or CW rotation. It should be noted that the configuration describe above is an exemplary one and the number/size of the transmission gears may be varied in accordance with the distance from the driving gear 69 to the transmission gear 152.

The planetary gear unit 153 is configured such that a supporting arm 156 is coaxially and rotatably provided to a shaft 155 of a sun gear 154. Further, two planetary gears 157 and 158 to engage with the sun gear 154 are supported by the supporting arm 156.

The sun gear 154 is a dual gear integrally formed large diameter gear 154L and a small diameter gear 154S having the same shaft 155. The supporting arm 156 is rotatably supported by the shaft 155 of the sun gear 154 and supports the planetary gears 157 and 158. The planetary gears 157 and 158 respectively engage with the small diameter gear 154S of the sun gear 154. When the sun gear 154 rotates, the planetary gears 157 and 158 engaged with the small diameter gear 154S also rotate. Further, as the sun gear 154 rotates, the supporting arm 156 also rotates in the same direction. That is, when the sun gear 154 rotates, the planetary gears 157 and 158 move around the sun gear 154 with rotating.

At a tip portion of the supporting arm 156 where the planetary gear 157 is supported, an engaging protrusion 159 is formed. When the engaging protrusion 159 engages with the connecting/disconnecting mechanism 151, the supporting arm 156 making the CCW rotation with respect to the shaft 155 of the sun gear 154 is stopped at a predetermined position. The attitude of the supporting arm 156 when the supporting arm 156 is stopped by the connecting/disconnecting mechanism 151 as shown in FIG. 4 will be referred to a disengaged attitude.

The connecting/disconnecting mechanism 151 includes an engaging member 160 and the solenoid 161. The engaging member 160 has an arm section 163 extending from a shaft 162 to the supporting arm 156 in a radial direction, an engaging hook 164 formed at the tip of the arm portion 163, and a driven section 165 extended from the shaft 162 in the radial direction. The engaging hook 164 can engage with the engaging protrusion 159 of the supporting arm 156. As the arm section 163 is rotated about the shaft 162, the engaging hook 164 engages with/disengages from the engaging protrusion 159. The driven section 165 is connected with a shaft 166 of the solenoid 161. The solenoid 161 operates such that the shaft 166 is linearly retracted in a main body when the power is supplied, and when the power is cut, the shaft 166 is linearly protruded by an elastic force. The movement of the shaft 166 is transmitted to the driven section 165, thereby the engaging member 160 is rotated about the shaft 162 and a predetermined attitude is realized.

When the solenoid 161 is OFF, the engaging member 160 is positioned such that the engaging hook 164 can engage with the engaging protrusion 159 of the supporting arm 156 as indicated by solid lines in FIG. 4. The engaging member 160 can be rotate in CW direction from this engaging attitude, and by use of spring or the like to urge, the attitude shown in FIG. 4 is maintained unless external force is applied. The engaging protrusion 159 rotates as the supporting arm 156 rotates. However, the rotating direction is substantially the radial direction of the engaging member 160 in the engaging attitude. Therefore, even if the rotational force of the supporting arm 156 is transmitted to the engaging member 160 via the engaging protrusion 159, the engaging member 160 will not rotate from the engaging attitude against the urging force applied by the spring or the like. When the solenoid 161 is ON, as indicated by two-dotted lines in FIG. 4, the engaging member 160 changes its attitude such that the engaging hook 164 is released from the engaging protrusion 159.

As shown in FIG. 4, the transmission gear 152 engages with the large diameter gear 154L. As the driving force of the motor 67 is transmitted and the transmission gear 152 rotates in a predetermined direction, the sun gear 154 rotates in the predetermined direction. For example, as shown in FIG. 4, when the driving gear 69 rotates in CCW direction, the transmission gear 152 makes the CW rotation and the sun gear 154 rotates in the CCW direction. Then, the planetary gears 157 and 158 rotate in the CCW direction. As the planetary gears 157 and 158 revolve around the sun gear 154, the supporting arm 156 rotates, and the engaging protrusion 159 of the supporting arm 156 is locates at a position where it can engage with the engaging hook 164. At this stage, if the solenoid 161 is OFF, as shown in FIG. 4, the engaging hook 164 engages with the engaging protrusion 159, and the rotation of the supporting arm 156 is restricted. In this state, neither the planetary gear 157 nor 158 engages with the transmission gear 167. Such an attitude of the supporting arm 156, that is, when each of the planetary gears 157 and 158 does not engage with the transmission gear 167 will be referred to as the disengaging attitude of the supporting arm 156. Until the engaging hook 164 engages with the engaging protrusion 159 and the solenoid 161 is ON, the CCW rotation of the supporting arm 156 is restricted, and the supporting arm 156 is held in the disengaging attitude.

As shown in FIG. 4, the transmission gear 167 is arranged next to the planetary gear unit 153. The transmission gear 167 can engage with the planetary gears 157 and 158. The transmission gear 167 is a dual gear having integrally formed large diameter gear 167L and small diameter gear 167S having the common shaft. The planetary gears 157 and 158 can engage with/disengage from the large diameter gear 167L. The small diameter gear 167S engages with a driven gear 168 provided to the shaft of the reversible roller 43. It should be noted that the configuration of the gear mechanism from the transmission gear 167 to the driven gear 168 is not limited to that of the above-described embodiment, and various modification can be made depending on a distance between the transmission gear 167 to the driven gear 168.

As shown in FIG. 5, when the drive gear 69 makes the CW rotation, the transmission gear 152 rotates in the CCW direction, and the sun gear 154 rotates in the CW direction. Then, the planetary gears 157 and 158 revolve around the sun gear 154 in the CW direction. As the planetary gears 157 and 158 revolve around the sun gear 154, the supporting arm 156 also rotates. When the supporting arm 156 rotates in the CW direction, the engaging protrusion 159 is released from the engaging hook 164. Therefore, even if the solenoid 161 is OFF, the supporting arm 156 can rotate in the CW direction. As the planetary gears 157 and 158 revolve around the sun gear 154 in the CW direction, the planetary gear 157 engages with the transmission gear 167.

As the planetary gear 157 rotates in the CW direction and engages with the transmission gear 167, the revolution of the planetary gear 157 around the sun gear 154 is restricted. Then, the planetary gear 157 receives the driving force from the gin gear 154 and rotates in the CCW direction. Then, the transmission gear 167 rotates in the CW direction, and the driven gear 168 is rotated in the CCW direction. As the driven gear 168 rotates in the CCW direction, the reversible roller 43 is rotated in the returning direction.

In the state shown in FIG. 4, if the solenoid 161 is ON, the engaging member 160 is rotated and the engaging hook 164 is released from the engaging protrusion 159. Thus, if the CCW rotation of the driving gear 69 is transmitted, the supporting arm 156 can rotate in the CCW direction, and the planetary gears 157 and 158 rotate in the CCW direction. As shown in FIG. 6, as the planetary gear 158 revolved around the sun gear 154 in the CCW direction and engages with the transmission gear 167, the revolution of the planetary gear 158 around the sun gear 154 is restricted. Then, the planetary gear 158 receives the driving force of the sun gear 154 and rotates in the CW direction. Then, the transmission gear 167 rotates in the CCW direction, and the driven gear 168 rotates in the CW direction. As the driven gear 168 rotates in the CW direction, the reversible roller 43 is rotated in the drawing direction. It should be noted that the solenoid 161 may be ON only when the engaging hook 164 is released from the engaging protrusion 159, and even if the solenoid 161 is OFF after the supporting arm 156 is rotated, from the disengaged attitude, in the CCW direction, the engaging hook 164 will not engage with the engaging protrusion 159.

When the rotating of the driving gear 67 is switched from the CCW rotation to the CW rotation, the supporting arm 156 can rotate in the CW direction from a state shown in FIG. 6, where the planetary gear 158 engages with the transmission gear 167. As the supporting arm 156 orates in the CW direction, the engaging state is change to that shown in FIG. 5, where the planetary gear 157 engages with the transmission gear 167. As the rotation of the driving gear 67 is switched from the CW rotation to the CCW rotation, the supporting arm 156 rotates in the CCW direction from the state shown in FIG. 5, and the attitude of the supporting arm 156 is changed to the disengaging attitude as shown in FIG. 4, where the engaging hook 164 engages with the engaging protrusion 159.

Hereinafter, the image reading operation by the image reading device 1 will be described.

The image reading device 1 can be used as the FBS instead of using the ADF 3. However, usage of the FBS is not related to the present invention. Therefore, the image reading operation using the FBS will be omitted for brevity. When the ADF 3 is used for image reading, the document cover 4 is closed with respect to the document table 2. The open/close of the document cover 4 is detected by a sensor provided to the document table 2. The image reading device 1 is controlled such that the ADF 3 can be used when the closure of the document cover 4 is detected by the sensor. When the ADF 3 is used, the document Gn to be read by the image reading device 1 is placed in the input tray 30. The document Gn is placed such that the surface to be read (first surface) is oriented upward (i.e., in a face-up state). The document Gn may be one sheet or a plurality of sheets. For example, when a plurality of sheets of document Gn having the same size are read, the document Gn is placed in the input tray 30 such that the first surface of the first sheet faces upward.

When an image reading start command is input to the image reading device 1, the motor 67 is driven and the pickup roller 33, separation roller 34, feed rollers 35A-35D, discharge roller 36 and reversible roller 43 are driven to rotate at predetermined timings, respectively. Further, the arm 29 is moved down and the pickup roller 33 is press-contacted with an original document Gn placed on the input tray 30. Then, the document Gn is fed to the feed path from the topmost original document G1 which directly receives the rotational force of the pickup roller 33 and the separation roller 34, one by one with being separated from the remaining sheets. The original document Gn as fed is guided by the feed path 32 and directed to the reading position. Then, an image formed on the original document Gn is read by the image reading unit 22 which is located below the image reading position. After the image has been read, the original document Gn is discharged onto the output tray 31. During the image reading operation, the feeding path of the original document Gn differs in a case when only one side of the original document Gn is read and when both sides of the original document Gn are read. Whether a one-side reading operation is executed or both-side reading operation is executed is determined based on whether a one-side reading mode is set or both-side reading mode is set by the user before the reading operation is started.

Figure 7:
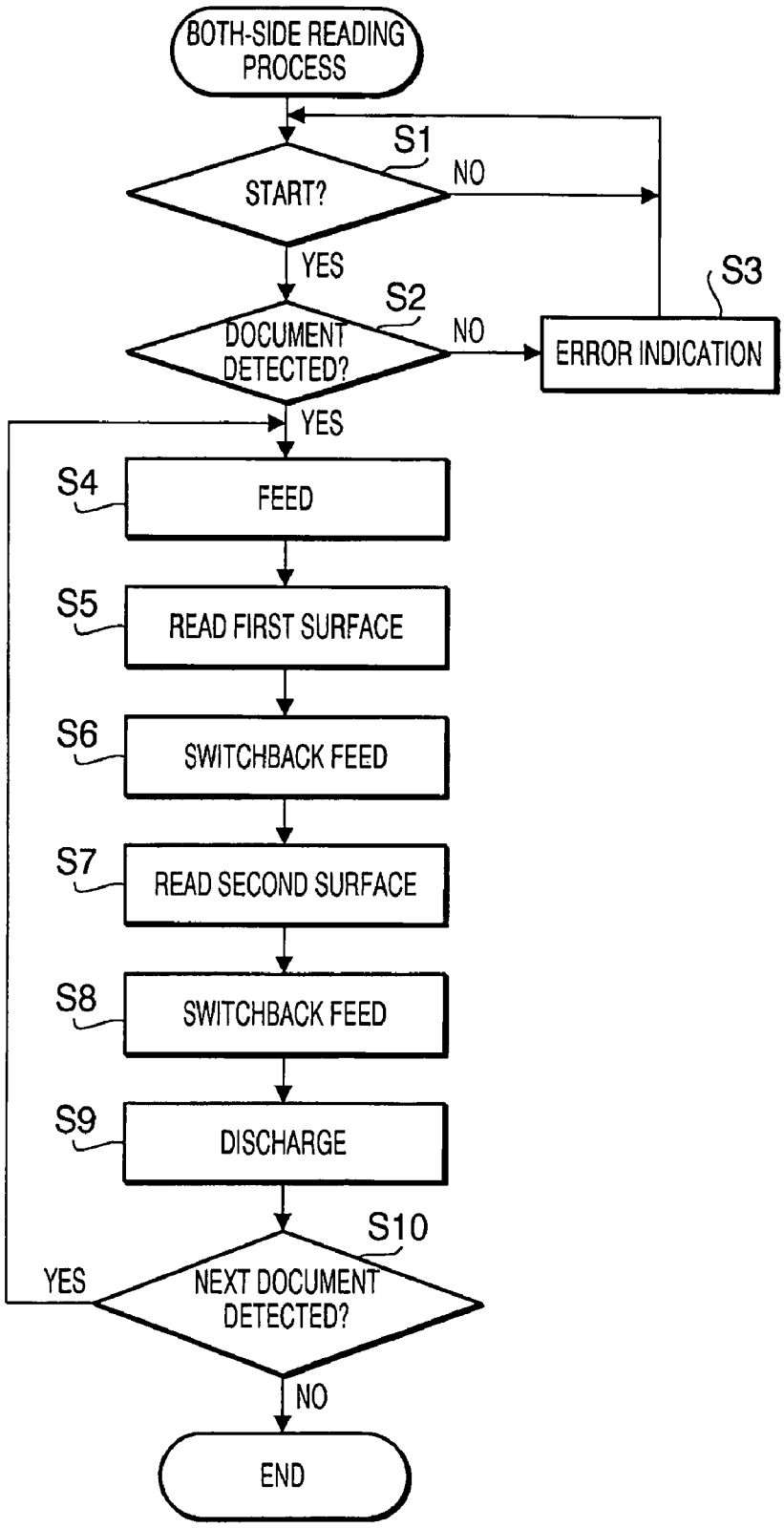
FIG. 7 shows a flowchart illustrating an image reading process in a both-side reading mode according to aspects of the invention.

FIG. 7 is a flowchart illustrating an image reading process in the both-side reading mode. FIGS. 8-14 show feeding states of the document Gn in the both-side reading mode. In these figures, indication of "FIRST" and "SECOND" for the document Gn represents the surface firstly read and the surface secondly read in the both-side reading mode, respectively. Therefore, the "FIRST" and "SECOND" represents the front and back surfaces of each document Gn.

Hereinafter, the both-side reading process executed by the image reading device 1 will be described. It should be noted that, when the one-side reading mode is set, the document Gn fed from the input tray 30 is fed along the U-shaped feed path 32, and reaches the reading position at which the first surface of the document Gn faces the reading position (i.e., the image reading unit 22). After the reading of the first surface is completed, the document Gn is discharged to the output tray 31. Such a one-side reading mode is well known, and a detailed description thereof will be omitted for brevity.

Figure 8:
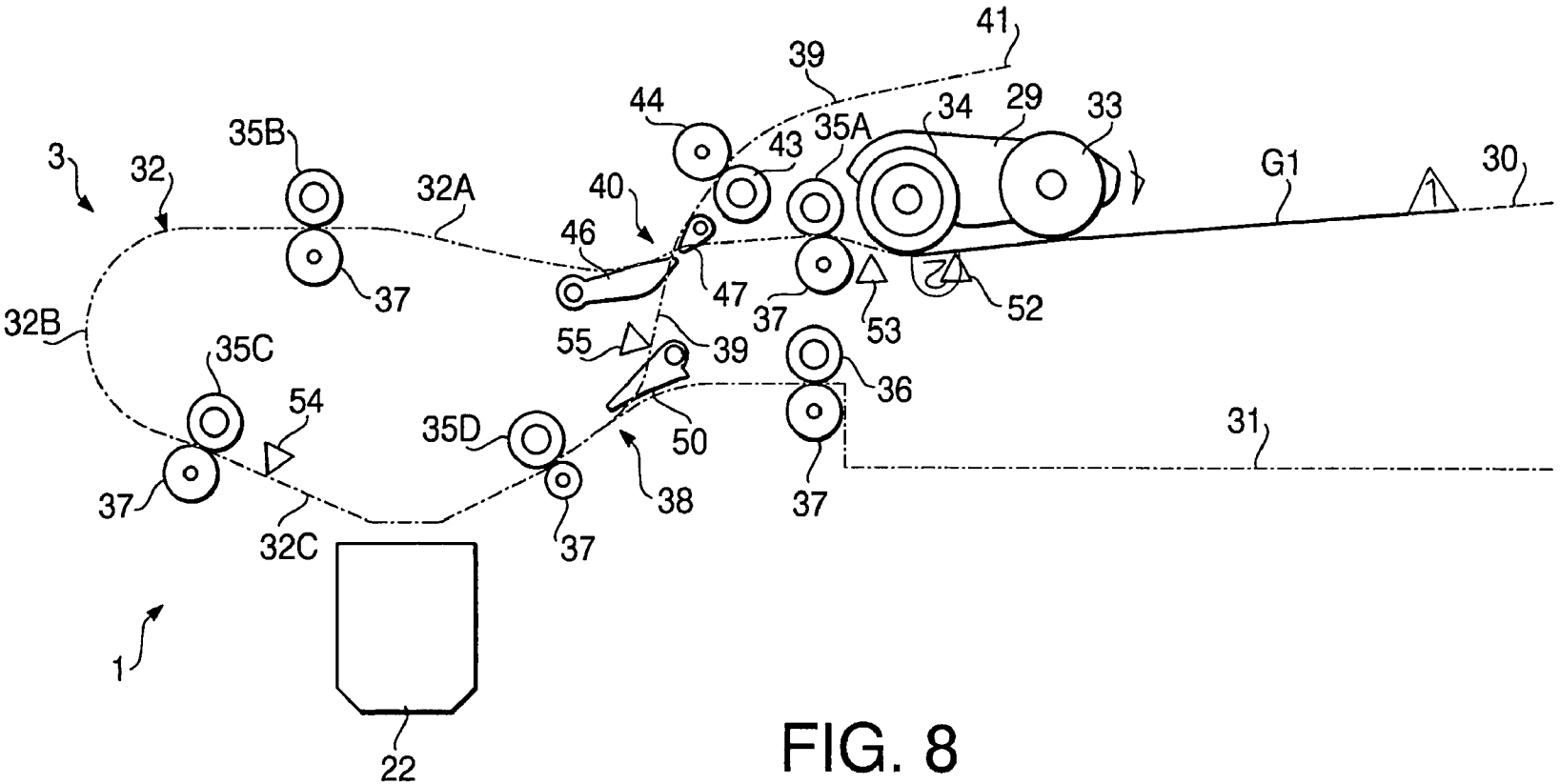
FIG. 8 is a side view schematically showing an operation of image reading process in the both-side reading mode.

Before the document Gn is fed, the guide flaps 50 are oriented at a position, as shown in FIG. 8, where the feed path 32 on the reading position side is connected to the feed path toward the output tray 31 at the connecting position 38. The guide flaps 46 are oriented at a position where the feed path 32 on the input tray 30 side is connected to the feed path 32 on the reading position side at the intersecting position 40. The guide flaps 47 are oriented at a position where the bidirectional feed path 39 on the end portion 41 is connected to the feed path 32 on the reading position side at the intersecting position 40.

When the reading start command is input to the image forming device 1 (FIG. 7: S1), the control unit 60 judges whether there is documents Gn on the input tray 30 using the first front sensor 52 (S2). If the control unit 60 determines, based on the output of the first front sensor 52, that no documents Gn are place on the input tray 30 (S2: NO), the control unit 60 controls the LCD unit 12 of the image reading device 1 to display an error message (e.g., "No Document") (S3). If the control unit 60 determines that the documents Gn are placed on the input tray 30 (S2: YES), the control unit 60 controls the motor 67 to rotate in the CW direction.

The driving force of the motor 67 is transmitted to the arm 29, the pickup roller 33 and the separation roller 34. With this configuration, the arm 29 moves down and the pickup roller 33 is press-contacted with the top sheet G1 of the original document Gn placed on the input tray 30. Further, as the pickup roller 33 and the separation roller 34 rotates in the drawing direction, the top sheet G1 of the original document Gn is introduced in the feed path 32. When a plurality of sheet of the original documents Gn are placed on the input tray 30, it sometimes occur that a second sheet G2 is fed together with the top sheet G1. According to the exemplary embodiment, a separation pad provided at a position opposite to the separation roller 34 prevents such a condition, and only the top sheet G1 is fed in the feed path 32 (S4).

As described previously, the driving force of the motor 67 is transmitted to the feed rollers 35A-35D, and discharge roller 36, which rotate to feed the original document Gn from the upstream side to the downstream side of the feed path 32. The original document Gn fed from the input tray 30 to the feed path 32 is nipped by the feed roller 35A and the corresponding pinch roller 37, and the rotational force is transmitted to the original document Gn. The original document Gn is thus fed to the intersecting position 40. As the original document is fed in the feed path 32, the second front sensor 53 is turned ON.

Figure 9:
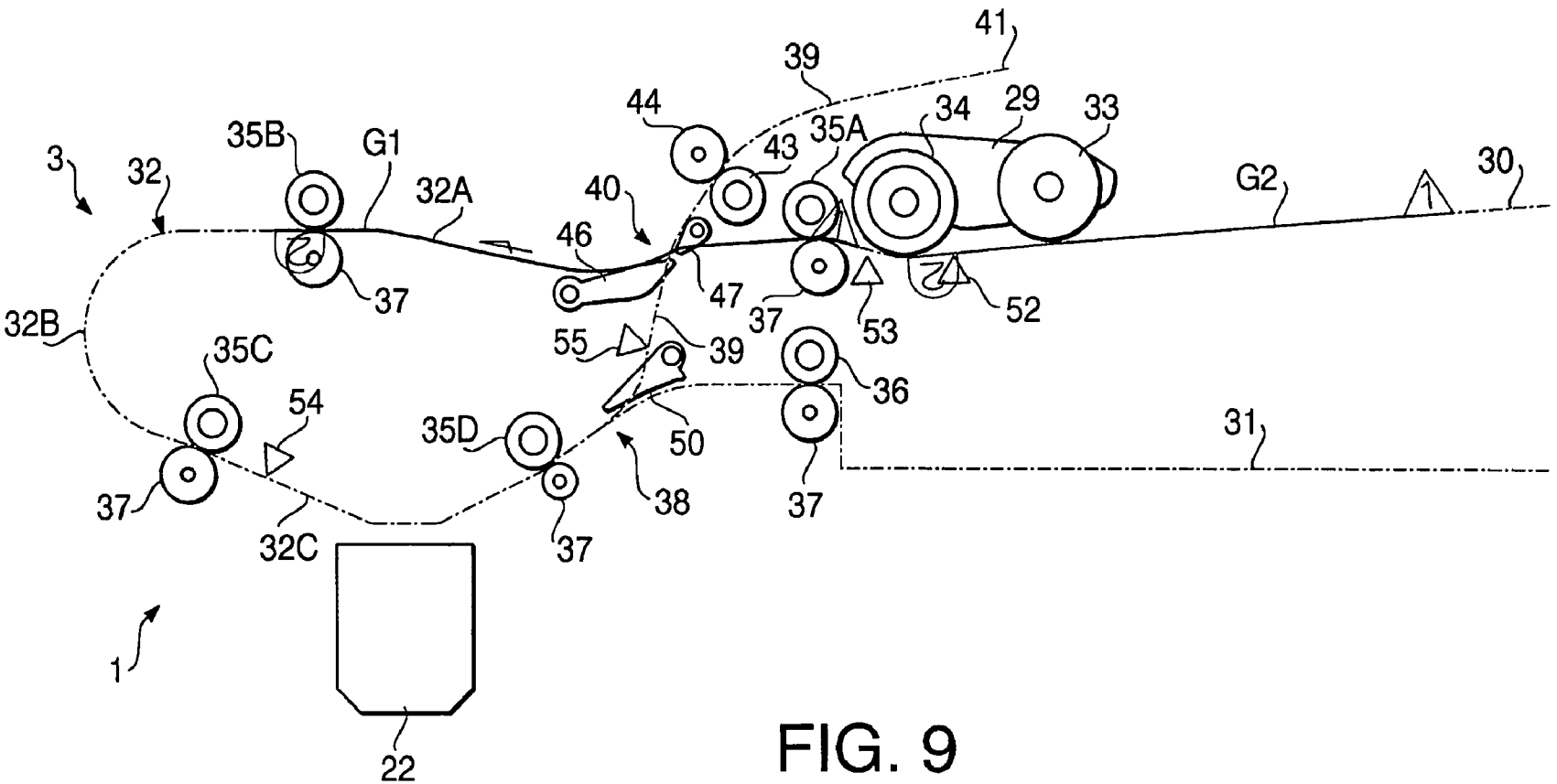
FIG. 9 is a side view schematically showing the operation of image reading process in the both-side reading mode.

The guide flaps 47 closes a feed path from the feed path 32 on the input tray 30 side toward the intersecting position 40. Therefore, the document G1 fed toward the intersecting position 40 contacts the guide flaps 47. Then, as shown in FIG. 9, the guide flaps 47 rotate in the CW direction as pushed by the original document G1 fed along the feed path 32. As the guide flaps 47 rotate, the feed path 32 on the input tray side is connected to the reading position side at the intersecting position 40, and further, the path towards the end position 41 of the bidirectional feed path 39 is closed at the intersecting position 40. Further, by the guide flaps 46, the feed path towards the connecting position 38 of the bidirectional feed path 39 is also closed at the intersecting position 40. Therefore, the original document G1 fed from the input tray 30 side portion of the feed path 32 to the intersecting position 40 is guided by the guide flaps 46 and 47 and directed to the reading position side thereof, without entering the bidirectional feed path 39 directed to the end position 41 or the connecting position 38.

When the leading end of the original document G1 has reached a predetermined position which is an upstream side in the feeding direction with respect to the reading position of the feed path 32, the control unit 60 switches the rotation of the motor 67 from the CW rotation to the CCW rotation. It should be noted that, to the feed rollers 35A-35D and the discharge rollers 36, driving forces for feeding the original document in the feeding direction are transmitted regardless of the rotation direction of the motor 67. Thus, after the motor 67 is controlled to rotate in the CCW direction, the original document G1 is fed toward the reading position by the feed rollers 35B and the like.

When the rotation of the motor 67 is switched from the CW rotation to the CCW rotation, the supporting arm 156 of the planetary gear unit 153 rotates in the CCW direction, and the driving force transmitting mechanism 150 engages with the connecting/disconnecting mechanism 151, thereby the driving force transmitting mechanism 150 is in the disconnecting attitude (state). In this sate, the transmission of the driving force from the planetary gear unit 153 to the driven gear 168 is cut, and the reversible rollers 43 are stopped. Further, as the motor 67 rotates in the CCW direction, the guide flaps 50 are set so that the original document is fed into the bidirectional feed path 39 at the connecting position 38. Further, as the trailing end of the original document GA1 pas passed the intersecting position 40, the guide flaps 47 are rotated back to their neutral position as shown in FIG. 8.

Figure 10:
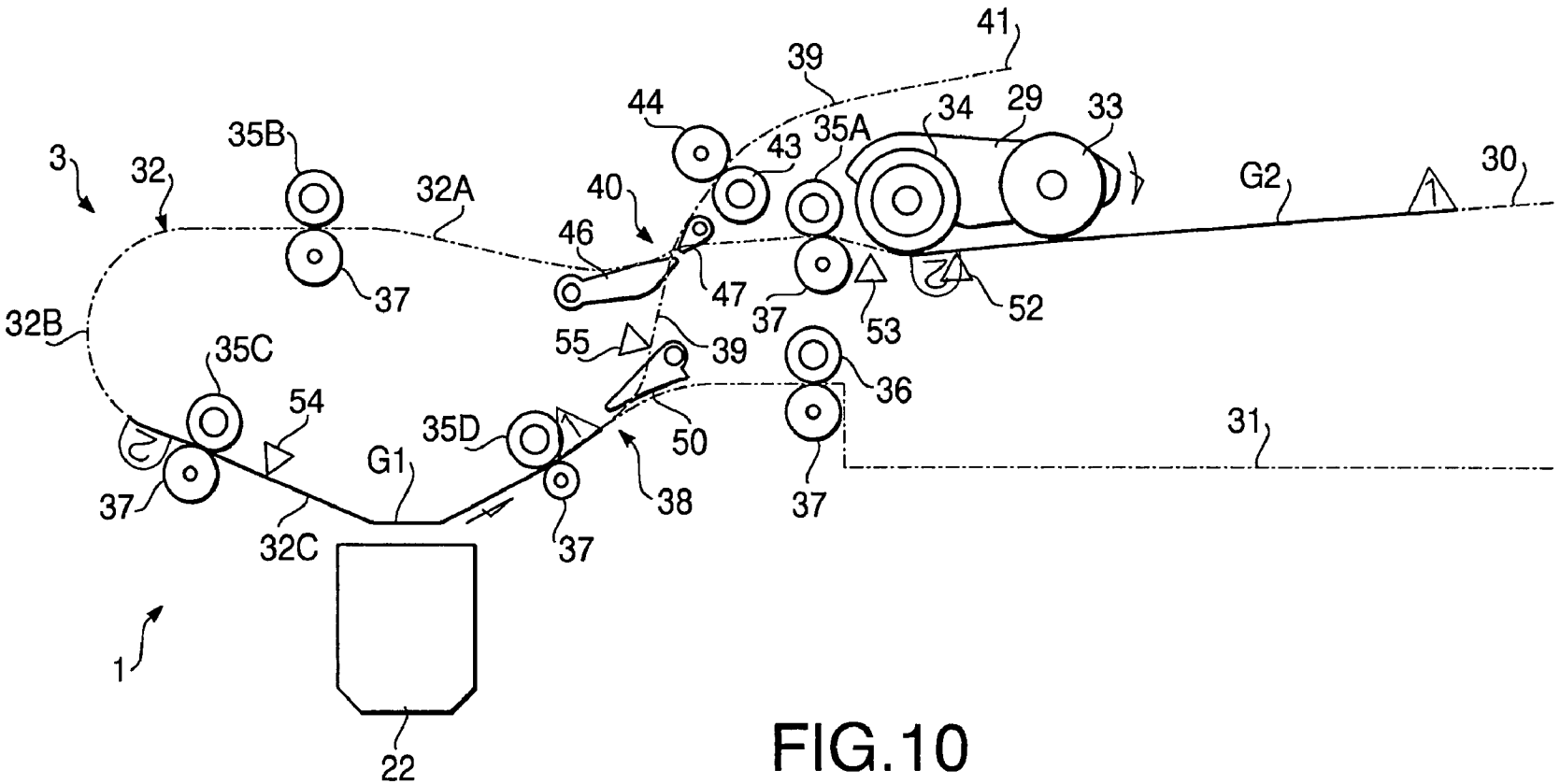
FIG. 10 is a side view schematically showing the operation of image reading process in the both-side reading mode.

As shown in FIG. 10, the original document G1 is fed in the feed path 32, and the front and back surface are reversed as it passed through the curved portion 32B. When the original document G1 passes through the curved portion 32B, the read sensor 54 detects the leading end of the original document G1 and is turned ON. The leading end of the original document G1 reaches the reading position predetermined period after the detection of the leading end of the original document G1. When the leading end of the original document G1 reaches the reading position, the control unit 60 controls the image reading unit 22 to operate and execute the image reading (S5). Firstly, the original document G1 is fed with the first surface thereof facing the image reading unit 22, and the image on the first surface of the original document G1 is read. When the trailing end of the original document G1 has passed the read sensor 54, the read sensor is turned OFF. The control unit 60 controls the image reading unit 22 to finish the image reading operation for reading the first surface of the original document G1 predetermined time after the status of the read sensor 54 is changed from ON to OFF. Image data read of the first surface of the original document G1 read by the image reading unit 22 is stored in a predetermined area or the RAM 63.

Figure 11:
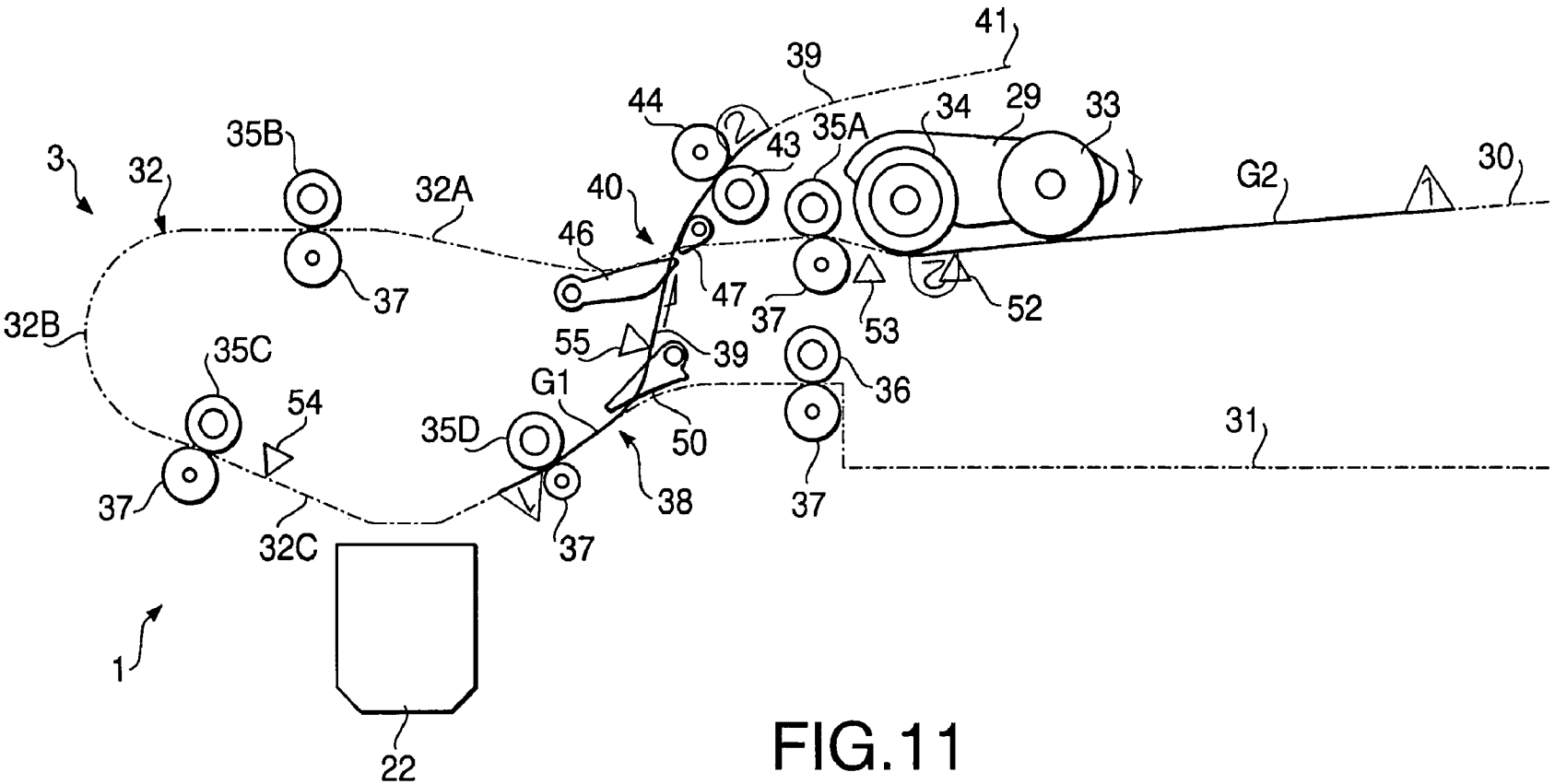
FIG. 11 is a side view schematically showing the operation of image reading process in the both-side reading mode.

The leading end of the original document G1 whose first surface has been read by the image reading unit 22 is guided by the guide flaps 50 and enters the bidirectional feed path 39 at the connecting position 38, as shown in FIG. 11. The sensor 55 is turned ON when it detects the leading end of the original document G1 that enters the bidirectional feed path 39. When the sensor 55 is turned ON, the control unit 60 turns on the solenoid 161. With this control, when the original document G1 enters the bidirectional feed path 39, the engagement between the connecting/disconnecting mechanism 151 with the supporting arm 156 is released. Thus, as show in FIG. 6, the planetary gear unit 153 receives the rotational force in the CCW direction from the motor 67, transmits the rotational force in the CW direction to the driven gear 168, thereby the reversible rollers 43 rotate in the drawing direction. The control of the solenoid by the control unit 60 will be described in detail later.

The guide flaps 46 close the feeding path from the bidirectional feed path 39 to the intersecting position 40. Therefore, the leading end of the original document G1 that enters the bidirectional feed path 39 contacts the guide flaps 46 when it reaches the intersecting position 40. Then, the guide flaps 46 are pushed up by the leading end of the original document G1 and rotate in the CCW direction. Thus, the connecting position side of the bidirectional feed path 39 and the end portion side of the bidirectional feed path 39 are connected at the intersecting position 40, while the feed path toward the reading position side of the feed path 32 is closed. Further, by the guide flaps 47, the feed path 32 on the reed tray 30 side is also closed. Therefore, the leading end of the original document G1 that is fed from the connecting position 38 and has reached the intersecting position 40 is guided by the guide flaps 46 and 47 and fed into the bidirectional feed path 39 without entering the feed path 32. Then, the leading end of the original document G1 is nipped by the reversible rollers 43 and corresponding pinch rollers 44. As the reversible rollers 43 rotate in the drawing direction, the original document G1 is fed through the bidirectional feed path 39 toward the end position 41.

Figure 12:
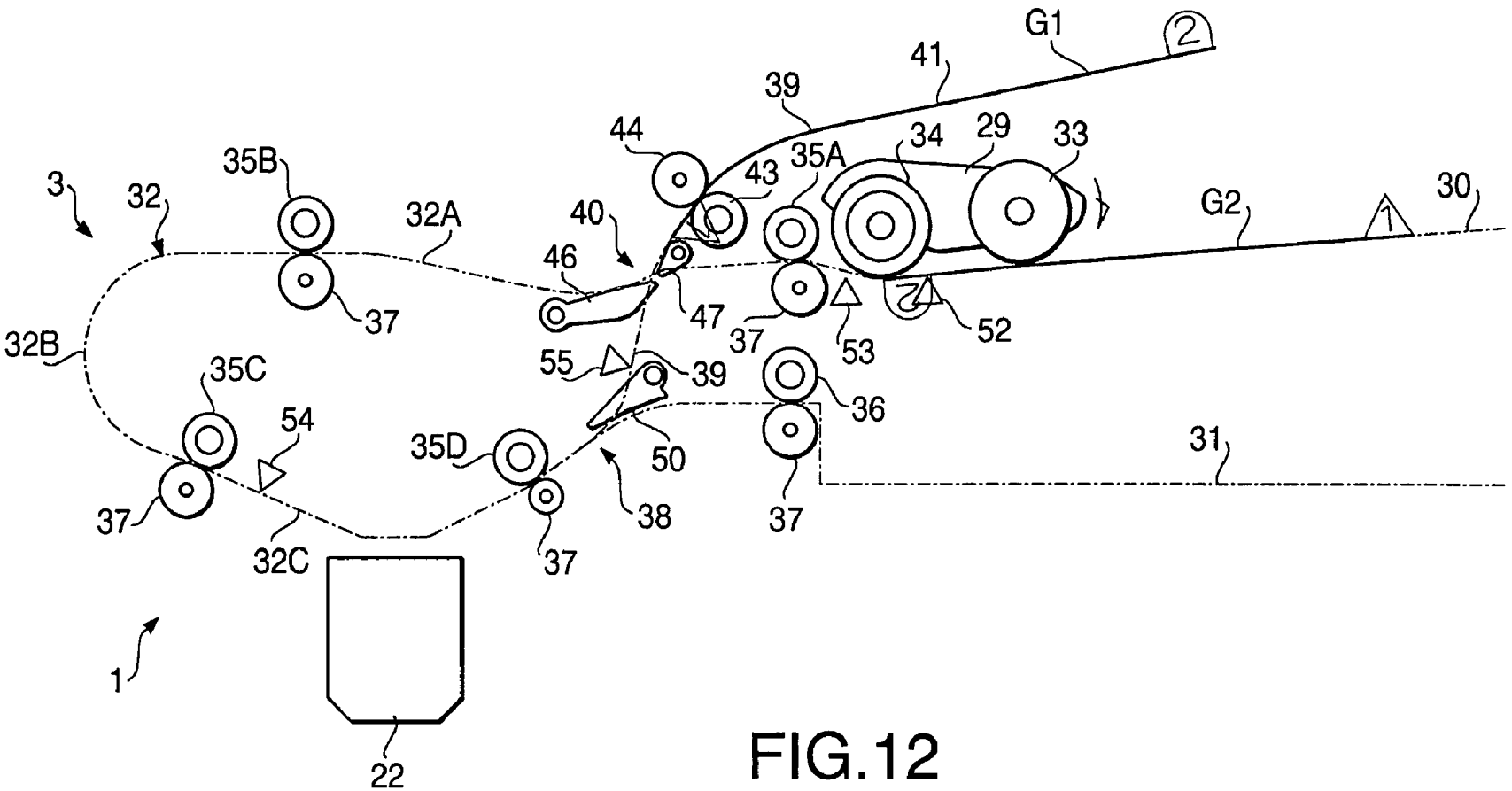
FIG. 12 is a side view schematically showing the operation of image reading process in the both-side reading mode.

As shown in FIG. 12, after the trailing end of the original document G1 has completely passed through the intersecting position 40 of the bidirectional feed path 39 and has entered the end position 41 side thereof, the control unit 60 switches the rotation of the motor 67 from the CCW rotation to the CW rotation. The sensor 55 is turned OFF as the trailing end of the original document G1 has passed through the sensor 55. When a predetermined period has passed after the turning OFF of the sensor 55, the trailing end of the original document G1 passes through the intersecting position 40. Therefore, the control unit 60 judges whether the trailing end of the original document G1 has passed through the intersecting position 40 and completely entered the end position 41 side of the bidirectional feed path 39 based on the detection signal of the sensor 55 and a feeding amount or feeding period of the feed roller 35D and reversible rollers 43. As the rotation direction of the motor 67 is switched, the original document G1 protruded outward from the end position 41 with being nipped by the reversible rollers 43 and pinch rollers 44 is returned toward the intersecting position 40.

When a part of the original document G1 is protruded outside the ADF 3 through the end position 41 of the bidirectional feed path 39, at least a portion of the protruded part is supported by the document supporting unit 42. As the original document G1 passes through the intersecting position 40 and releases from the guide flaps 46, the guide flaps 46 rotate downward (i.e., in the CW direction) and return to their neutral position as shown in FIG. 8.

Since the rotational direction of the motor 67 is switched from the CCW direction to the CW direction, the planetary gear unit 153 of the driving force transmitting mechanism 150 moves such that, as shown in FIG. 5, the supporting arm 156 rotates in the CW direction and the driving force of the motor 67 is transmitted to the driven gear 168, thereby the driven gear 168 rotating in the CCW direction. With this CCW rotation of the driven gear 168, the reversible rollers 43 rotate in the returning direction. Then, the original document G1 is fed through the bidirectional feed path 39 toward the intersecting position 40 (i.e., the bidirectional feed is executed) (S6).

Figure 13:
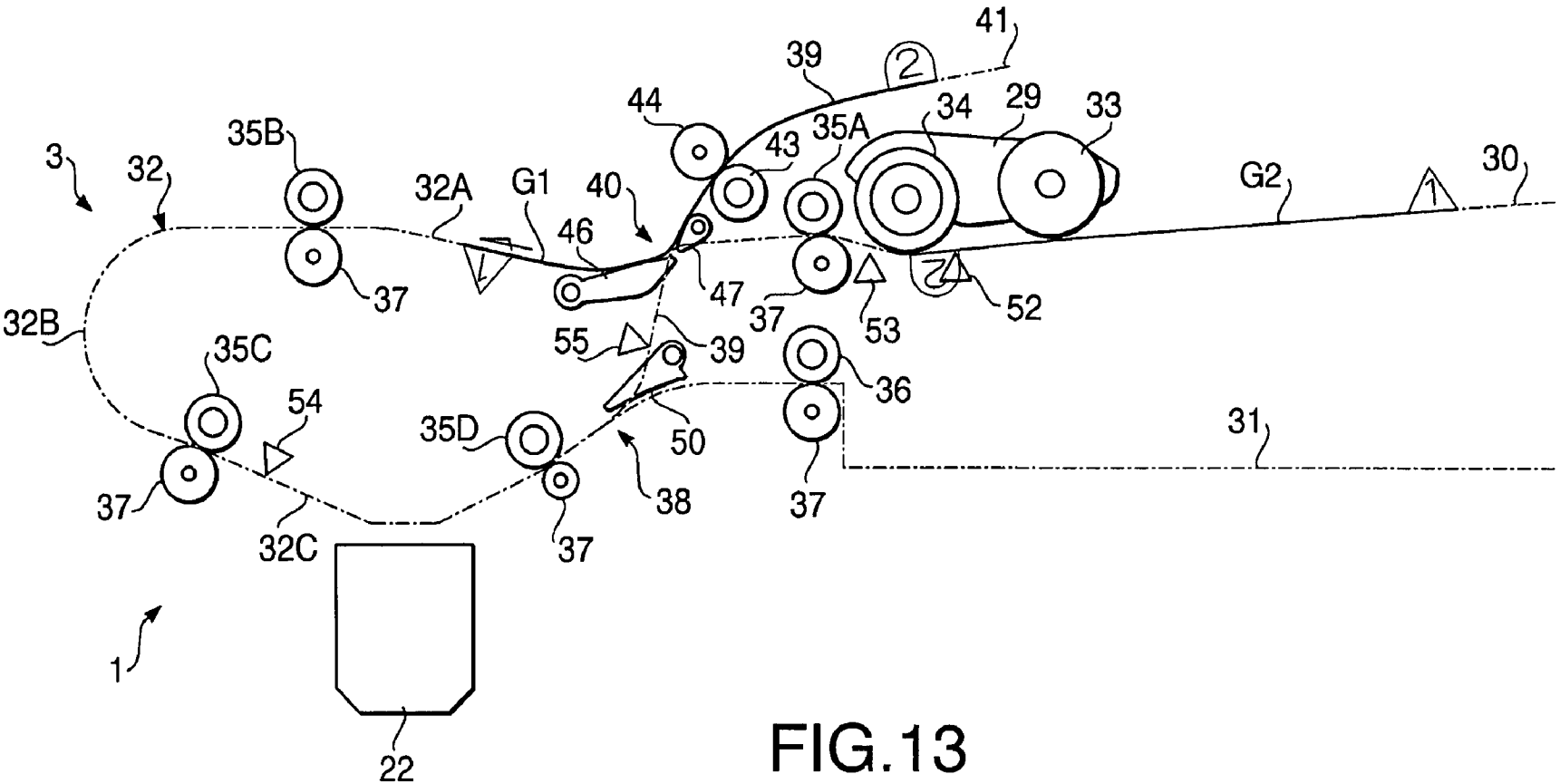
FIG. 13 is a side view schematically showing the operation of image reading process in the both-side reading mode.

The original document G1 returning through the bidirectional feed path 39 contacts the guide flaps 46 at the intersecting position 40, as shown in FIG. 13. The guide flaps are configured not to rotate downward (i.e., in the CW direction) from the position shown in FIG. 13. Therefore, the end position 41 side path of the bidirectional feed path 39 is connected to the reading position side path of the feed path 32, and a path toward the connecting position 38 of the bidirectional feed path 39 is closed at the intersecting position 40. Further, the guide flaps 47 close a path toward the input tray 30 side of the feed path 32. Therefore, the original document G1 is guided by the guide flaps 47 and 47, and the reading position side path of the feed path 32 without entering the bidirectional feed path 39 toward the connecting position 39 or the feed path 32 toward the input tray 30 side. As the original sheet G1 is returned from the bidirectional feed path 39 to the upstream side of the reading position of the feed path 32, the original document G1 is re-fed in the feed path with the leading end and the trailing end is reversed in comparison with a state where the original document G1 was firstly fed. As above, the bidirectional feed of the original document G1 is done. The original document G1 is fed such that it passes the reading position with the second surface facing the image reading unit 22.

When the leading end (in the feeding direction) of the original document G1 has reached a predetermined position that is on the upstream side of the reading position, the control unit 60 controls the motor 67 to switch the rotation direction thereof from the CW rotation to the CCW rotation. As described before, regardless of the rotation direction of the motor 67, the feed rollers 35A-35D and discharge roller 36 transmits the driving force for forwardly feeding the original document G1. Therefore, after the rotation direction of the motor 67 has been switched, the original document G1 is kept fed toward the reading position through the feed path 32. Further, as the motor is switched to rotate in the CCW direction, the guide flaps 50 are moved to a position at which the original document G1 is guided from the feed path 32 to the bidirectional feed path 39 at the connecting position 38.

When the rotation of the motor 67 is switched from the CW rotation to the CCW rotation, the supporting arm 156 of the planetary gear unit 153 rotates in the CCW direction and engages with the connecting/disconnecting mechanism 151 and is in the disconnecting attitude. With this movement, the transmission of the driving force from the planetary gear unit 153 to the driven gear 168 is disconnected and the reversible rollers 43 are stopped. Therefore, even if the rotation direction of the motor 67 is switched with a portion of the leading end (in the feeding direction) of the original document G1 being nipped by the feed rollers 35B and pinch rollers 37, and the trailing end of the original document G1 being nipped by the reversible rollers 43 and the pinch rollers 44, the reversible rollers 43 will not rotated in the drawing direction. The reversible rollers 43 which are disconnected from the motor 67 are driven by the original document G1 fed by the rotation of the feed rollers 35B to rotate.

Figure 14:
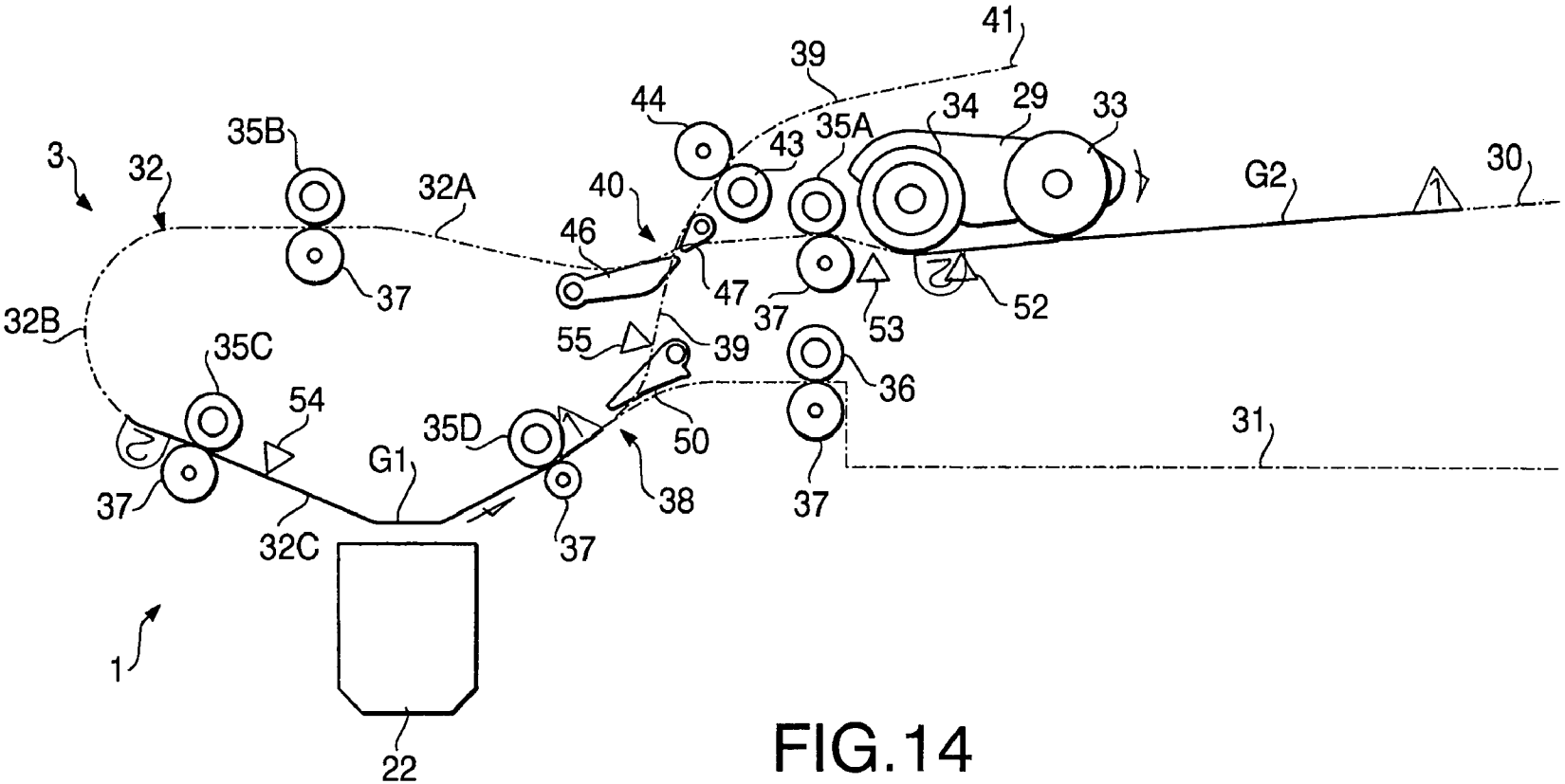
FIG. 14 is a side view schematically showing the operation of image reading process in the both-side reading mode.

When the leading end (in the feeding direction) of the original document G1 is detected by the read sensor 54 and the leading end has reached the reading position, as shown in FIG. 14, the control unit 60 controls the image reading unit 22 to read the image on the second surface of the original document G1 (S7). The leading end of the original document G1, whose second surface has been read, is guided by the guide flaps 50 and enters the bidirectional feed path 39 at the connecting position 38. When the trailing end of the original document G1 is detected by the read sensor 54 and the trailing end has reached the reading position, the control unit 60 finishes the reading of the image on the second surface of the original document G1. The image data of the second surface read by the image reading unit 22 is stored in a predetermined area of the RAM 63.

When the sensor 55 detects the leading end of the original document G1 that enters the bidirectional feed path 39 and is turned ON, the control unit 60 turns ON the solenoid 161 in accordance with a control which will be described later. As the solenoid 161 is turned ON, the engagement of the supporting arm 156 with the connecting/disconnecting mechanism 151 is released when the original document G1 is introduced in the bidirectional feed path 39. As shown in FIG. 6, the planetary gear unit 153 which receives the rotational force of the motor 67 in the CCW direction transmits the driven gear the rotational force in the CW direction, thereby the reversible rollers 43 rotating in the drawing direction.

The leading end (in the feeding direction) of the original document G1 reached the intersecting position 40 pushes up the guide flaps 46 as in FIG. 11 and proceeds toward the end position 41 of the bidirectional feed path 39. Then, similar to the state shown in FIG. 12, after the trailing end of the original document G1 has passed the intersecting position 40 and completed entered the end position 41 side of the bidirectional feed path 39, the control unit 60 switches the rotation of the motor 67 from the CCW direction to the CW direction to rotate the reversible rollers 43 in the returning direction, thereby the original document G1 returned to the intersecting position 40. Then, similar to the state shown in FIG. 13, the original document G1 returned from the bidirectional feed path 39 is guided by the guide flaps 46 and 47, fed toward the reading position side of the feed path 32 from the end position 41 side or the bidirectional feed path 39. With the above movement, the original document G1 is fed through the feed path 32 again, with its leading end and trailing end being reversed, in a state similar to that when the original document G1 was firstly fed.

As described previously, the feed rollers 35A-35D and discharge roller 36 rotate in a direction where the original document G1 is fed forward. Further, when the rotation of the motor 67 is switched from the CCW direction to the CW direction, the guide flaps 50 rotate in the direction where original document is fed from the reading position side of the feed path toward the output tray 31.

Thereafter, the original document G1 passes through the reading position with the first face facing the reading position, is guided to the output tray 31 side at the connecting position 38 by the guide flaps 50, and is discharge onto the output tray 31 with the first surface being oriented downward (S9). If a next original document G2 is set in the input tray 30 (S10: YES), that is, if the first front sensor 52 is ON, the control unit 60 operates so that the driving force of the motor 67 is transmitted to the pickup roller 33 and the separation roller 34. With this control, the pickup roller 33 and the separation roller 34 are rotated in the feeding direction. Then, the original document G2 on the input tray 30 is introduced in the feed path 32, and the both-side reading operation is executed for the original document G2 similarly. If there is no original document in the input tray 30 (S10: NO), the control unit 60 finishes the both-side reading process.

In the exemplary embodiment described above, the image reading device 1 is configured such that the order of the plurality of sheets of the original documents placed on the input tray 30 is kept when the plurality of sheets of the original documents are discharged onto the output tray 31. However, if the order of a plurality of discharged sheets may not be the same as the order of the plurality sheets of the original document Gn placed on the input tray 30, the above configuration may simplified such that the original document whose second surface has been read may be discharged without making the same to re-enter the bidirectional feed path. According to such a modification, although the order of the sheets is not maintained, the both-side reading of the documents can be done in a less period of time.

Figure 15:
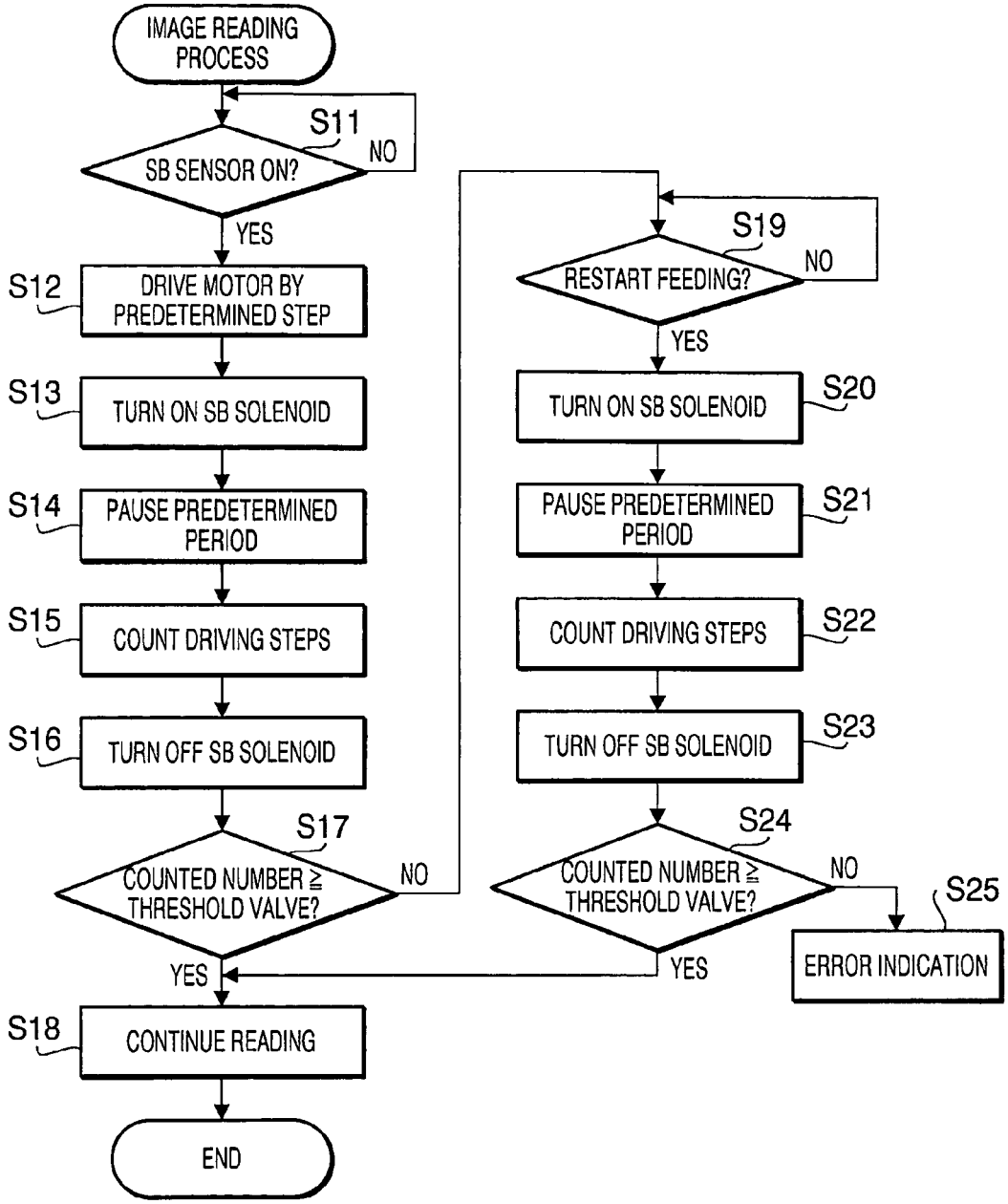
FIG. 15 shows a flowchart illustrating a switchback solenoid control process according to aspects of the invention.
Figure 16:
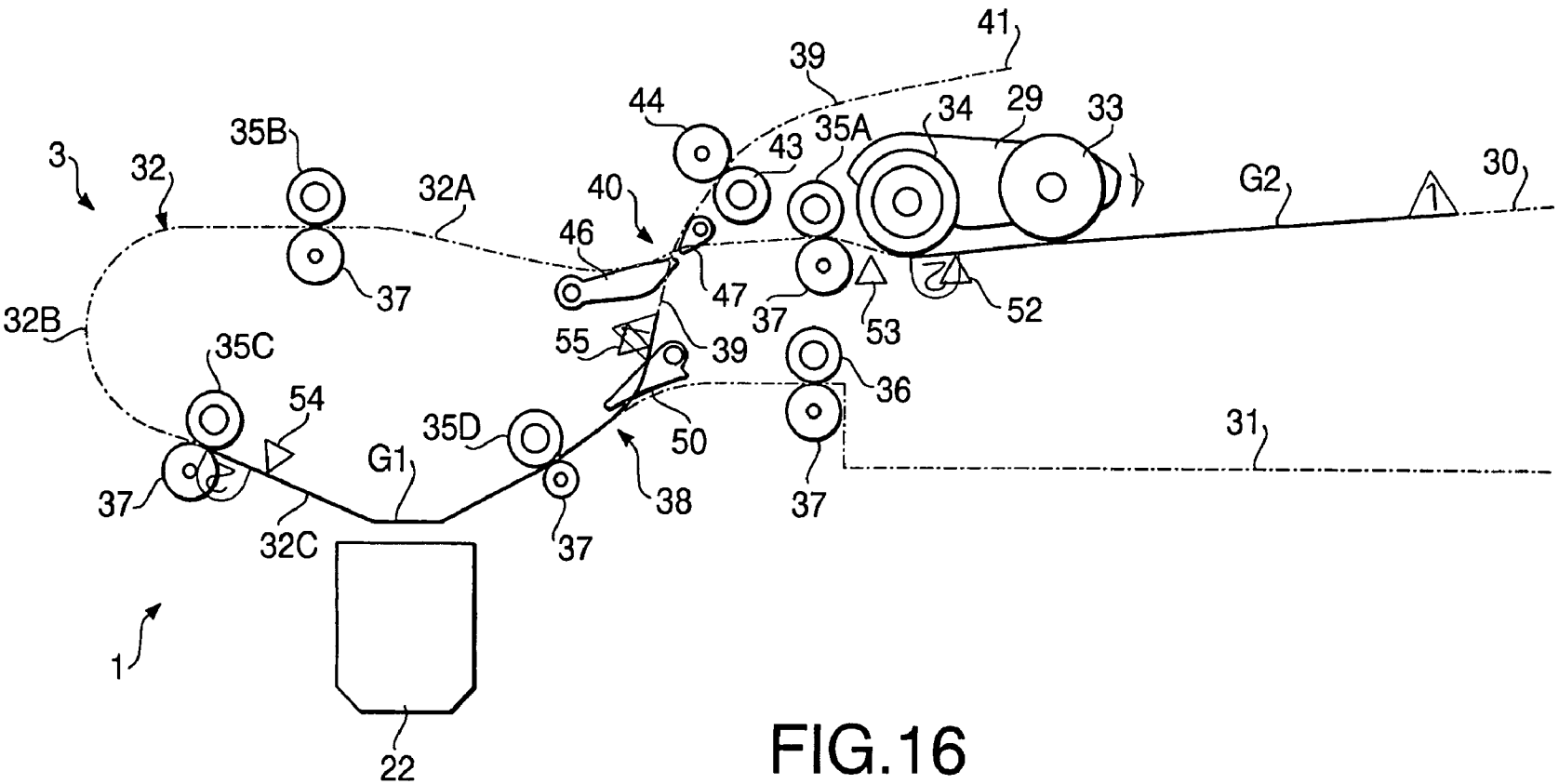
FIG. 16 is a side view schematically showing the operation of image reading process in the both-side reading mode.
Figure 17:
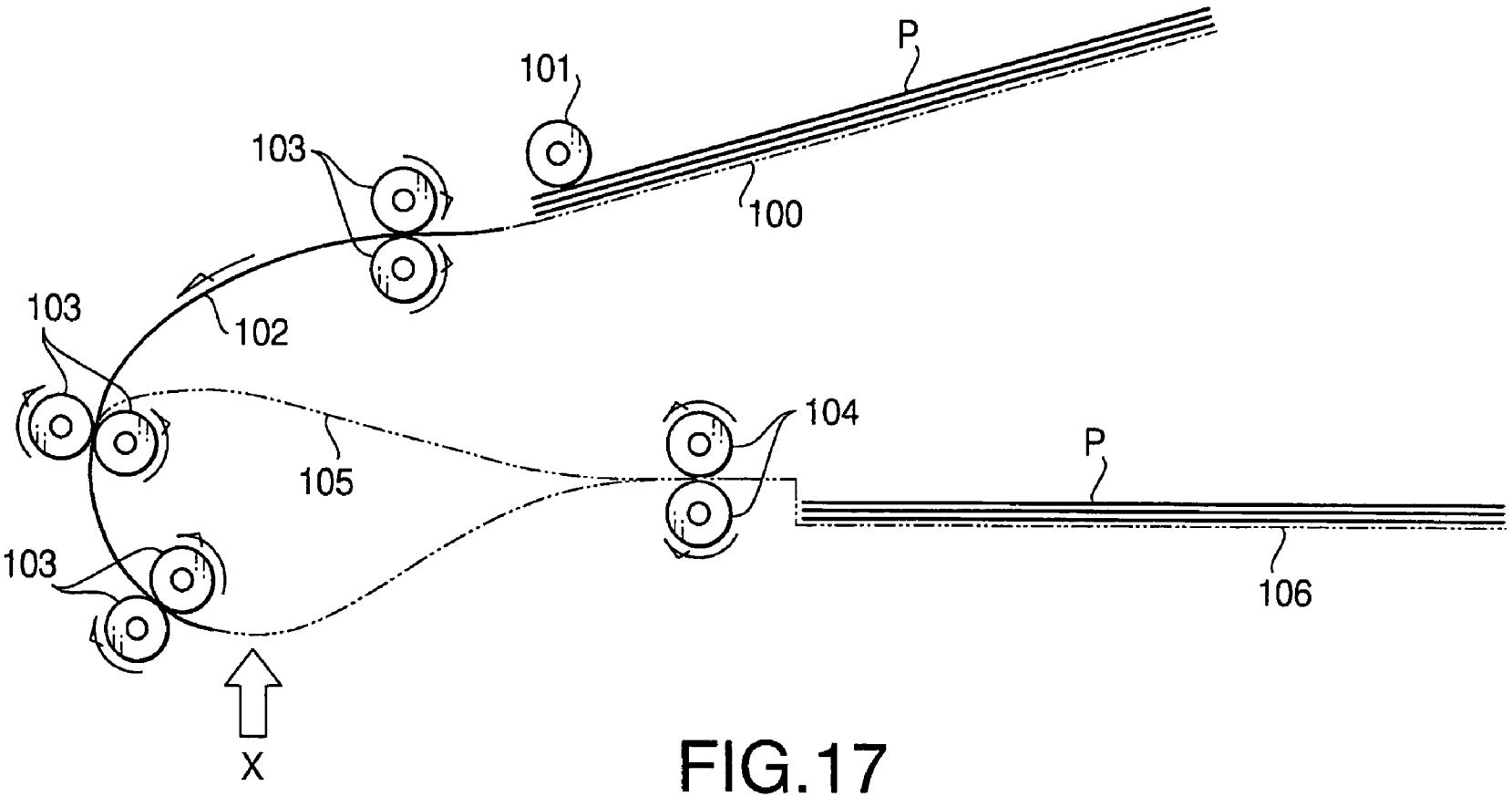
FIG.17 PRIOR ART
FIG. 17 is a side view schematically showing an operation of image reading process in the both-side reading mode of a conventional ADF.
Figure 18:
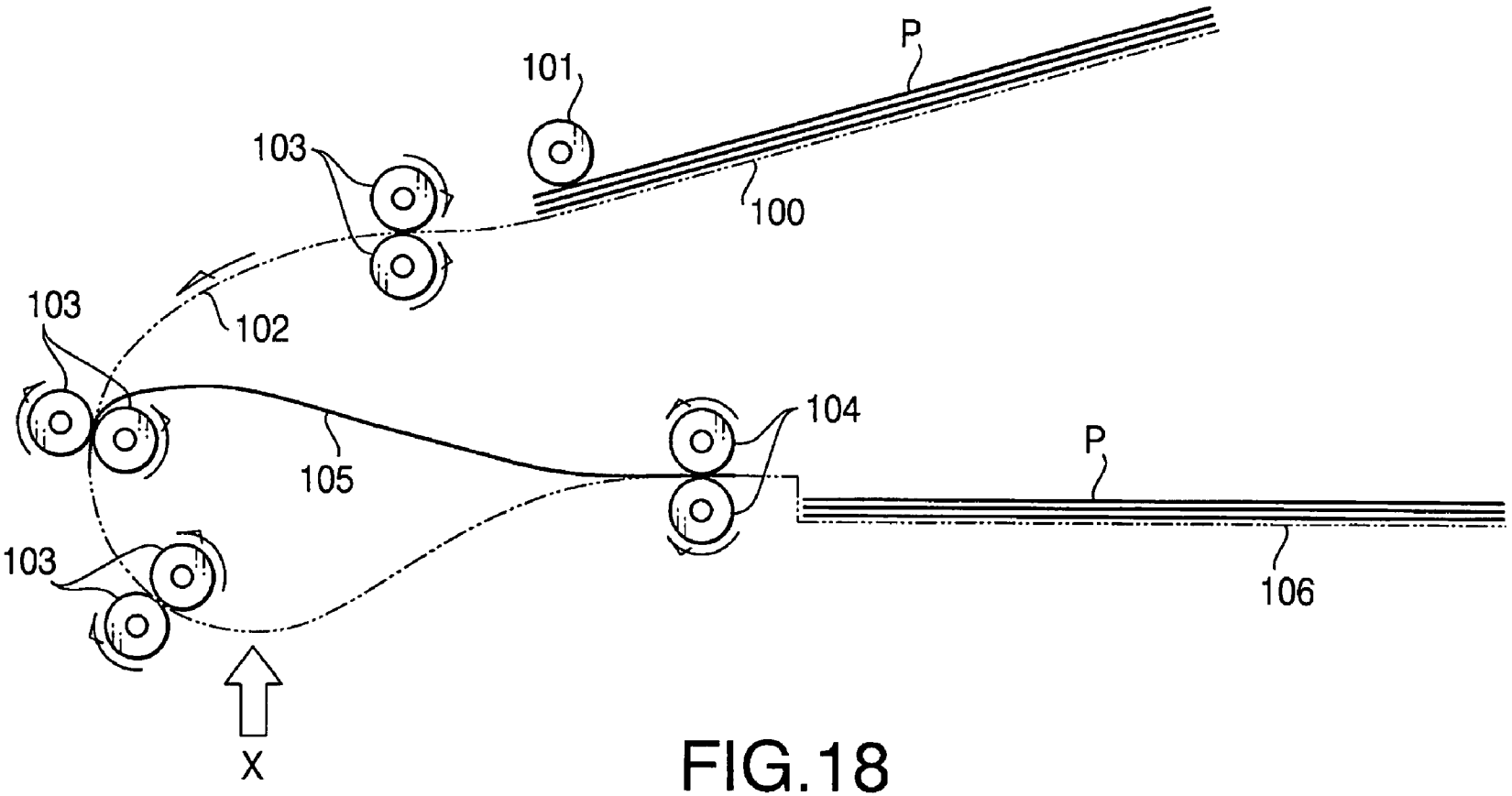
FIG.18 PRIOR ART
FIG. 18 is a side view schematically showing an operation of image reading process in the both-side reading mode of the conventional ADF.

Next, control of the solenoid 161 by the control unit 60 will be described in detail. FIG. 15 is a flowchart illustrating a solenoid control process, and FIG. 16 schematically shows a state where the motor 67 is stopped when the original document G1 has been fed by a predetermined amount after the leading end of the original document G1 was detected by the sensor 55.

As previously described, when the original document G1 is fed from the input tray 30 into the feed path 32, and the leading end of the original document G1 has reached the reading position, the control unit 60 controls the image reading unit 22 to read the image on the original document G1. This control is the same regardless the first surface is read or the second surface is read. Thereafter, the leading end of the original document G1 is guided by the guide flaps 50 and enters the bidirectional feed path 39, and is detected by the sensor 55. When the leading end is detected, the sensor 55 is turned ON (S11: YES).

After the switchback sensor was turned ON, the control unit 60 drives the motor 67 a by a predetermined number of steps (S12), and then turns ON the solenoid 161 (S13). The number of steps for driving the motor 67 should be appropriately determined based on the accuracy of the sensor 55, the distance from the sensor 55 to the reversible rollers 43, and the like. When the solenoid 161 is turned ON, as shown in FIG. 6, the engagement of the planetary gear unit 153 by the connecting/disconnecting mechanism 151 is released.

The control unit 60 keeps the solenoid 161 tuned ON for a predetermined period (S14). During the predetermined period, the control unit 60 counts the number of the steps for driving the motor 67 (S15), and then turned OFF the solenoid 161 (S16). Thus, the control unit 60 turns ON the solenoid for the predetermined period and counts the number of the pulses applied to the motor 67 (i.e., the rotating amount of the motor 67) during the period. The period during which the ON state of the solenoid 161 is kept is a time period sufficient for rotating the supporting arm 156 in the CCW direction and make the planetary gear 158 engage with the large diameter gear 167L of the transmission gear 167 even if the motor 67 is rotated at its lowest speed. It should be noted that the motor 67 is the stepping motor and the rotation amount of the motor 67 is obtained based on the number of the pulses applied to the motor 67 according to the exemplary embodiment. However, the invention needs not be limited to this configuration of the exemplary embodiment, and can be modified. Thus, another parameter which can be obtained to represent the rotation amount of a driving source can be used.

Next, the control unit 60 judges whether the counted number of steps of the driving pulses is equal to or greater than a predetermined number (which is a threshold value) (S17). The threshold value has been determined and stored in the ROM 62 in advance. The threshold value is, for example, the number of steps necessary for rotating the supporting arm 156 to move the planetary gear 157 or 158 in the disconnected state as shown in FIG. 4 and make the planetary gear 157 or 158 engage with the large diameter gear 167 as shown in FIG. 6. If the number of the driving steps for the motor 67 during the ON state of the solenoid is greater than the threshold value (S17: YES), the supporting arm 156 that receives the rotational force in the CCW direction from the motor 67 rotates in the CCW direction and the planetary gear 158 engages with the large diameter gear 167L of the transmission gear 167. Therefore, if the control unit 60 turns OFF the solenoid 161 thereafter, the planetary gear 158 kept engaged with the transmission gear 167, the rotational force in the CW direction is transmitted to the driven gear 168 and the reversible rollers 43 are rotated in the drawing direction. Thus, as shown in FIG. 4, the driving force transmission mechanism 150, which has been disconnected by the connecting/disconnecting mechanism 151, is connected such that the driving force generated by the motor 67 is transmitted to the reversible rollers 43. After the leading end of the original document G1 was detected by the sensor 55, the image reading is performed with respect to the tailing end portion of the original document G1, and the control unit 60 keeps executing the image reading (S18).

There is a case where the number of driving steps during the ON state of the solenoid 161 is less than the threshold value (S17: NO). As previously described, the feed rollers 35B and 35C feed the original document G1 such that the first surface or the second surface faces and passes through the reading position. The feeding speed of the feed rollers 35B and 35C correspond to the reading resolution. For example, the control unit 60 has two feeding speed settings: a low feeding speed setting which corresponds to a high reading resolution and is for feeding the original document G1 at a low feeding speed of VL; and a high feeding speed setting which corresponds to a low reading resolution and is for feeding the original document G1 at a high feeding speed of VH. Then, the control unit 60 judges whether the reading resolution is the high resolution or low resolution based on the setting which was made before the reading operation, determines the feeding speed of the original document G1 when passing through the reading position, and drives the motor 67 to meet the determined feeding speed.

If the reading resolution is set to the high resolution, the control unit 60 feeds the original document G1 at the low feeding speed VL at the reading position, and controls the image reading unit 22 to read the image with a larger number of reading lines than in the low resolution mode. Therefore, in the high resolution mode, the amount of image data of the first surface or the second surface of the original document G1 is larger in comparison with that in the low resolution mode. The image data of the first surface or the second surface of the original document G1 read by the image reading unit 22 is stored in the predetermined area of the RAM 63. In the high resolution mode, however, due to the large amount of data, there may occur a case where all the data of the first or second surface cannot be stored in the predetermined area at a time. In such a case, the control unit 60 interrupts reading of the image of the first or second surface if the data amount will exceeds the amount that can be stored in the predetermined area of the RAM 63, and temporarily terminates the reading operation until a further space for storing the image data for the remaining part of the image becomes available. During the interruption, a further area for storing the data becomes available as, for example, the stored image data is transferred to an external device such as a computer, the control unit 60 restarts the feeding of the original document G1 and reading of the image thereon.

The temporary interruption of the feeding of the original document G1 may occur due to not only the high reading resolution but a larger size of the original document or the reading of a color image and the like, that causes the data amount to increase. If the image reading device 1 is configured as a scanner of a multi-function device, since various data (e.g., facsimile data and print data) is also stored in the RAM 63 as well as the image data, the space available for the image data of the original document G1 may become smaller, which may cause such an temporary termination of the image reading.

Such a temporary interruption of the feeding may occur after the leading end of the original document G1 was detected by the sensor 55 and the original document G1 has fed by a certain amount (i.e., when the control unit 60 maintains the ON state of the solenoid 161). If, for example, the feeding of the original document G1 is interrupted almost the entire period during which the solenoid 161 is turned ON, the motor 67 is driven little during the period, and the number of steps counted by the control unit 60 is close to zero. In such a case, the number of driving steps during the solenoid 161 is turned ON is less than the threshold value (S17: NO).

In the above exemplary case, the supporting arm 156 rotate little and thus the attitude thereof changes little in comparison with the disconnected attitude shown in FIG. 4. Therefore, if the control unit 60 turns OFF the solenoid, the engaging hook 164 engages with the engaging protrusion 159 of the supporting arm 156 again. In such a state, if the feeding of the original document G1 is restarted and the motor 67 is rotated in the CCW direction, since the rotation of the supporting arm 156 is restricted by the engaging member 160, the disconnected state of the planetary gears 157 and 158 are maintained and the transmission of the driving force through the driving force transmitting mechanism 150 is kept disconnected. That is, in the above case, the feeding of the original document G1 is restarted with the operation to connect to the driving force transmission mechanism 150 is incomplete.

When the feeding of the original document G1 is restarted (S19: YES), the control unit turns ON the solenoid 161 again (S20) and maintains the state for a predetermined period (S21). Then, the control unit 60 counts the number of the driving steps of the motor 67 during the predetermined period (S22) and thereafter turns OFF the solenoid 161 (S23). That is, similar to the above, the control unit 60 turns ON the solenoid 161 for a predetermined period and counts the driving steps of the motor 67 during the predetermined period.

Next, the control unit 60 judges whether the number of the driving steps as counted is equal to or greater than the threshold value (S24). The threshold value is set similar to the value set in S17. Therefore, if the number of the driving steps when the solenoid 161 is turned ON is equal to or greater than the threshold value (S24: YES), the supporting arm 156 has received the driving force in the CCW direction from the motor 67 and has rotated in the CCW direction so that the planetary gear 158 has been engaged with the large diameter gear 167L. Therefore, the driving force of the motor 67 in the CCW direction is transmitted through the driving force transmission mechanism 150 and the reversible rollers 43 are rotated in the drawing direction. Then, the control unit 60 continues to execute image reading of the trailing end portion of the original document G1 (S18).

If the number of the driving steps when the solenoid 161 is turned ON is less than the threshold value (S24: NO), the control unit 60 stops the motor 67 and displays an error message on the LCD unit 12 (S25). The error message may include an indication of a document feed error, and optionally, a position where the original document G1 is located with a predetermined language. With this error message, the user can recognize the occurrence of the error. Further, since the motor 67 is stopped, the original document G1 will not be fed in a condition where the driving force is not transmitted to the reversible rollers 43 via the driving force transmitting mechanism 150, and thus, break of the original document G1 can be avoided. It should be noted that notification of the error condition should not be limited to the indication of the error message, and can be modified in various ways. For example, lighting of an LED, outputting of error sounds or other human inceptive method may be alternatively or optionally employed.

According to the image reading device 1 described above, the control unit 60 controls the motor 67 to rotate in the CCW direction and turns ON the solenoid 161 at a predetermined timing. If the number of the driving steps of the motor 67 when the solenoid 161 is turned ON is less than the threshold value, the control unit 60 turns ON the solenoid again. Therefore, the transmission of the driving force through the driving force transmitting mechanism 150 is ensured. With this configuration, in the feeding of the original document for both-side reading, the reversible rollers 43 can be driven at a predetermined timing and executes the bidirectional feed without fail.

Further, the control unit 60 is configured to turn ON the switchback solenoid 161 if the feeding of the original document is once interrupted and the motor 67 is restarted to restart the feeding operation. Therefore, whenever the switchback solenoid 161 is turned ON, the motor 67 is driven to rotate. If the motor 67 is temporarily stopped immediately after the motor 67 is started to rotate, a sufficient driving force for rotating the supporting arm 156 in the CCW direction and make the planetary gear 158 engage with the transmission gear 167 during an accelerating period to achieve a predetermined rotation speed or decelerating period to stop the rotation through the driving force transmitting mechanism 150. Thus, the transmission of the driving force through the driving force transmitting mechanism 150 is ensured.

According to the exemplary embodiment, the control unit 60 actuates the solenoid 161 twice, and if the number of the driving steps of the motor 67 is still smaller than the threshold value, the control unit 60 displays the error message. The invention needs not be limited to this configuration and the control unit 60 may repeat the actuation the solenoid 161 again instead of displaying the error message after the second attempt, and if the error condition still exists, the error message may be displayed.

According to the exemplary embodiment, the bidirectional feed path 39 to re-feed the original document Gn to the feed path 32 is defined to start at the connecting position 38 located on the downstream side of the reading position and to intersect the feed path at the intersecting position 40 which is the upstream side of the reading position. Such a configuration is only an example, and the feed paths may be designed in various ways. Depending on the structure of the feeding paths, the guide flaps 46, 47 should be modified.

In the exemplary embodiment, the guide flaps 46 and 47 are formed as plate members and rotatably secured to respective positions. This configuration is only an exemplary one and can be modified in various ways. For example, the guide flaps 46 and 47 may be replaced with guide members which are not rotatable but formed of elastically deformable film members, respectively.

What is claimed is:

1. A document feeder, comprising:

an input tray configured to receive a document;

an output tray positioned one of above and below the input tray;

a document transfer path extending between an input tray and the output tray;

transfer elements for transferring the document from the input tray to the output tray;

a bidirectional feed path having two ends which are connected to predetermined positions of the document feeding path, respectively;

a bidirectional feed system provided to the bidirectional feed path to feed the document from a downstream side of an image reading position to an upstream side of the image reading position with a leading end and a trailing end of the document being reversed;

a driving system configured to apply a driving force to the bidirectional feed system;

a first transmitting mechanism configured to transmit the driving force for feeding the document in a first direction to the bidirectional feed system in accordance with one of the forward and backward rotations of the driving system, and to transmit the driving force for feeding the document in a second direction to the bidirectional feed system in accordance with the other one of the forward and backward rotations of the driving system;

a second transmitting mechanism configured to cut off or transmit the driving force of the driving system to the bidirectional feed system;

an actuator configured to selectively drive the second transmitting mechanism based on whether or not the driving force is desired to be transmitted to the bidirectional feed system, the second transmitting mechanism cutting off the driving force to the bidirectional feed system when the rotation of the driving system is switched from one of forward and backward rotation directions to the other rotation direction, and transmitting the driving force to the bidirectional feed system when the driving system rotates in the other rotation direction and when the actuator is operated; and a controller configured to actuate the actuator for a predetermined period, and to detect a rotating amount of the driving system in the other rotation direction during the predetermined period, wherein the controller determines whether or not to actuate the actuator again in accordance with the rotating amount of the driving system in the other rotation direction, wherein, if the rotating amount of the driving system within a period in which the actuator is actuated is less than the predetermined amount, the controller actuates the actuator after the driving system starts rotating in the other rotation direction, and the controller is further configured to actuate the actuator again when the driving system is stopped due to lack of memory for storing image data read from the document within a period in which the actuator is actuated.

2. The document feeder according to claim 1, wherein the driving system includes a single motor for driving the bidirectional feed system.

3. The document feeder according to claim 1, wherein if the actuator is actuated by a plurality of times and the rotating amount of the driving system within the period during which the actuator is actuated is less than a predetermined amount, the controller indicates occurrence of an error status.

4. The document feeder according to claim 1, wherein the controller determines to actuate the actuator again for a predetermined period if an interruption of the operation of the driving system occurs during the rotation of the driving system in the other direction.

5. The document feeder according to claim 1, further including a sensor located on a downstream side of the scanning position of the document feed path, wherein the controller controls the actuator to operate in response to detection of the leading end of the original document by the sensor.

6. The document feeding device according to claim 1, wherein the first transmitting mechanism includes:

a first transmission gear that receives the driving force from the driving system;

a sun gear engaging with the first transmission gear;

a first planetary gear and a second planetary gear respectively engage with the sun gear;

a second transmission gear which is engaged with one of the first planetary gear and the second planetary gear and transmits the driving force to the bidirectional feed system;

a rotatable member configured to be rotatable about the rotary axis of the sun gear, the rotatable member rotatably supporting the first planetary gear and the second planetary gear, rotation of the rotatable member in one direction making the first planetary gear disengage from the second transmission gear and making the second planetary gear engage with the second transmission gear, rotation of the rotatable member in an opposite direction, which is opposite to the one direction, making the first planetary gear engage with the second transmission gear and making the second planetary gear disengage from the second transmission gear, and wherein the second transmitting mechanism is configured to maintain a disengaged status where the first planetary gear and the second planetary gear are disengaged from the second transmission gear, the second transmitting mechanism including an engaging member that releases the engagement based on the operation of the actuator.

7. A document feeder, comprising:

an input tray configured to receive a document;

an output tray positioned one of above and below the input tray;

a document transfer path extending between an input tray and the output tray;

transfer elements for transferring the document from the input tray to the output tray;

a bidirectional feed path having two ends which are connected to predetermined positions of the document feeding path, respectively;

a bidirectional feed system provided to the bidirectional feed path to feed the document from a downstream side of an image reading position to an upstream side of the image reading position with a leading end and a trailing end of the document being reversed;

a driving system configured to apply a driving force to the bidirectional feed system;

a first transmitting mechanism configured to transmit the driving force for feeding the document in a first direction to the bidirectional feed system in accordance with one of the forward and backward rotations of the driving system, and to transmit the driving force for feeding the document in a second direction to the bidirectional feed system in accordance with the other one of the forward and backward rotations of the driving system;

a second transmitting mechanism configured to cut off or transmit the driving force of the driving system to the bidirectional feed system;

an actuator configured to selectively drive the second transmitting mechanism based on whether or not the driving force is desired to be transmitted to the bidirectional feed system, the second transmitting mechanism cutting off the driving force to the bidirectional feed system when the rotation of the driving system is switched from one of forward and backward rotation directions to the other rotation direction, and transmitting the driving force to the bidirectional feed system when the driving system rotates in the other rotation direction and when the actuator is operated; and a controller configured to actuate the actuator for a predetermined period, and to detect a rotating amount of the driving system in the other rotation direction during the predetermined, wherein the controller determines whether or not to actuate the actuator again in accordance with the rotating amount of the driving system in the other rotation direction, wherein the first transmitting mechanism includes: a first transmission gear that receives the driving force from the driving system; a sun gear engaging with the first transmission gear; a first planetary gear and a second planetary gear respectively engage with the sun gear;

a second transmission gear which is engaged with one of the first planetary gear and the second planetary gear and transmits the driving force to the bidirectional feed system;

a rotatable member configured to be rotatable about the rotary axis of the sun gear, the rotatable member rotatably supporting the first planetary gear and the second planetary gear, rotation of the rotatable member in one direction making the first planetary gear disengage from the second transmission gear and making the second planetary gear engage with the second transmission gear, rotation of the rotatable member in an opposite direction, which is opposite to the one direction, making the first planetary gear engage with the second transmission gear and making the second planetary gear disengage from the second transmission gear, and wherein the second transmitting mechanism is configured to maintain a disengaged status where the first planetary gear and the second planetary gear are disengaged from the second transmission gear, the second transmitting mechanism including an engaging member that releases the engagement based on the operation of the actuator.

8. The document feeder according to claim 7, wherein the driving system includes a single motor for driving the bidirectional feed system.

9. The document feeder according to claim 7, wherein if the actuator is actuated by a plurality of times and the rotating amount of the driving system within the period during which the actuator is actuated is less than a predetermined amount, the controller indicates occurrence of an error status.

10. The document feeder according to claim 7, wherein the controller determines to actuate the actuator again for a predetermined period if an interruption of the operation of the driving system occurs during the rotation of the driving system in the other direction.

11. The document feeder according to claim 7, further including a sensor located on a downstream side of the scanning position of the document feed path, wherein the controller controls the actuator to operate in response to detection of the leading end of the original document by the sensor.

12. A document feeder, comprising:

an input tray configured to receive a document;

an output tray positioned at one of above and below the input tray;

a document transfer path extending between the input tray and the output tray;

transfer elements configured to transfer the document from the input tray to the output tray, the transfer elements including:

a feed mechanism configured to move the document in a first direction; and a reversible mechanism configured to move the document a forward direction and a backward direction, which are opposite to one another at separate time;

a transmitting system configured to operate in:

a first condition for transmitting a driving force of a driving system to the feed mechanism, and a second condition for transmitting the driving force of the driving system to the reversible mechanism, the driving force to the reversible mechanism being cut off when a rotation of the driving system is switched from one of the forward and backward rotation directions to the other rotation direction;

a controller configured to control the transmitting system and to instruct a change of the condition of the transmitting system from one of the first condition and the second condition to the other in response to a start of the driving system if the driving system is stopped during the change of the condition of the transmitting system; and an actuator configured to drive the transmitting system so that the driving force of the driving system is transmitted to the reversible mechanism when the driving system rotates in the other rotation direction, wherein:

the controller is further configured to actuate the actuator for a predetermined period, and to detect a rotating amount of the driving system in the other direction during the predetermined period, the controller determines whether or not to actuate the actuator again in accordance with the rotating amount of the driving system in the other rotation direction, if the rotating amount of the driving system within a period in which the actuator is actuated is less than a predetermined amount, the controller actuates the actuator after the driving system starts rotating in the other rotation direction and the controller is further configured to actuate the actuator when the driving system is stopped due to lack of memory for storing image data read from the document within a period in which the actuator is actuated.

* * * * *